US009501965B2

(12) United States Patent
Ikeda et al.

(10) Patent No.: US 9,501,965 B2
(45) Date of Patent: Nov. 22, 2016

(54) IMAGE DISPLAY APPARATUS AND CONTROL METHOD THEREOF

(71) Applicant: CANON KABUSHIKI KAISHA, Tokyo (JP)

(72) Inventors: Takeshi Ikeda, Ebina (JP); Kohei Inamura, Sagamihara (JP); Mitsuru Tada, Machida (JP); Hiroshi Uchiike, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/975,858

(22) Filed: Aug. 26, 2013

(65) Prior Publication Data

US 2014/0055505 A1 Feb. 27, 2014

(30) Foreign Application Priority Data

Aug. 27, 2012 (JP) ..... 2012-186503

(51) Int. Cl.
*G09G 3/34* (2006.01)
*G09G 3/22* (2006.01)

(52) U.S. Cl.
CPC ..... *G09G 3/22* (2013.01); *G09G 3/3426* (2013.01); *G09G 2320/0233* (2013.01); *G09G 2320/0238* (2013.01); *G09G 2320/0646* (2013.01); *G09G 2320/0653* (2013.01); *G09G 2320/103* (2013.01); *G09G 2330/021* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 8,400,392 | B2 | 3/2013 | Kimura et al. | |
| 8,736,543 | B2 | 5/2014 | Kubota et al. | |
| 2007/0296886 | A1* | 12/2007 | Inada et al. | 349/61 |
| 2009/0002308 | A1 | 1/2009 | Yoshida | |
| 2011/0292018 | A1* | 12/2011 | Kubota et al. | 345/211 |
| 2012/0139885 | A1* | 6/2012 | Iwasa et al. | 345/207 |

FOREIGN PATENT DOCUMENTS

| | | | |
|---|---|---|---|
| JP | 2002-099250 | A | 4/2002 |
| JP | 2008-139569 | A | 6/2008 |

(Continued)

OTHER PUBLICATIONS

U.S. Appl. No. 13/961,174, filed Aug. 7, 2013, Takeshi Ikeda.

(Continued)

*Primary Examiner* — Joseph Haley
(74) *Attorney, Agent, or Firm* — Fitzpatrick, Cella, Harper & Scinto

(57) ABSTRACT

An image display apparatus according to the present invention includes: a light-emitting unit capable of separately controlling the emission brightness in each of a plurality of divided regions in a screen; a determining unit configured to determine a target brightness of a predetermined divided region, based on image data corresponding to the predetermined divided region; an estimating unit configured to estimate the brightness of the predetermined divided region when light is emitted by the light-emitting unit at emission brightness which is based on image data in each of the plurality of divided regions; and a control unit configured to control the emission brightness of two or more divided regions including the predetermined divided region based on the difference between the target brightness determined by the determining unit and the brightness estimated by the estimating unit.

21 Claims, 19 Drawing Sheets

(56) References Cited

FOREIGN PATENT DOCUMENTS

| | | | |
|---|---|---|---|
| JP | 2009-014746 | A | 1/2009 |
| JP | 2011-248215 | A | 12/2011 |

OTHER PUBLICATIONS

Office Action in Japanese Patent Application No. 2012-186503, dated May 31, 2016.

* cited by examiner

FIG. 4

| | 1 | 2 | 3 | 4 | 5 | 6 | 7 | 8 | 9 | 10 |
|---|---|---|---|---|---|---|---|---|---|---|
| 1 | 16 | 16 | 16 | 16 | 16 | 16 | 255 | 255 | 255 | 255 |
| 2 | 16 | 16 | 16 | 16 | 16 | 255 | 255 | 255 | 255 | 255 |
| 3 | 16 | 16 | 16 | 16 | 16 | 255 | 255 | 255 | 255 | 255 |
| 4 | 16 | 255 | 16 | 16 | 16 | 255 | 255 | 255 | 255 | 255 |
| 5 | 16 | 16 | 16 | 16 | 16 | 255 | 255 | 255 | 255 | 255 |
| 6 | 16 | 16 | 16 | 16 | 16 | 255 | 255 | 255 | 255 | 255 |
| 7 | 16 | 16 | 16 | 16 | 16 | 255 | 255 | 255 | 255 | 255 |
| 8 | 16 | 16 | 16 | 16 | 16 | 16 | 255 | 255 | 255 | 255 |

FIG. 7

| | 1 | 2 | 3 | 4 | 5 | 6 | 7 | 8 | 9 | 10 |
|---|---|---|---|---|---|---|---|---|---|---|
| 1 | 19 | 19 | 19 | 19 | 19 | 19 | 300 | 300 | 300 | 300 |
| 2 | 19 | 19 | 19 | 19 | 19 | 300 | 300 | 300 | 300 | 300 |
| 3 | 19 | 19 | 19 | 19 | 19 | 300 | 300 | 300 | 300 | 300 |
| 4 | 19 | 300 | 19 | 19 | 19 | 300 | 300 | 300 | 300 | 300 |
| 5 | 19 | 19 | 19 | 19 | 19 | 300 | 300 | 300 | 300 | 300 |
| 6 | 19 | 19 | 19 | 19 | 19 | 300 | 300 | 300 | 300 | 300 |
| 7 | 19 | 19 | 19 | 19 | 19 | 300 | 300 | 300 | 300 | 300 |
| 8 | 19 | 19 | 19 | 19 | 19 | 19 | 300 | 300 | 300 | 300 |

IMAGE DISPLAY APPARATUS AND CONTROL METHOD THEREOF

BACKGROUND OF THE INVENTION

Field of the Invention

The present invention relates to an image display apparatus and a control method thereof.

Description of the Related Art

There is a technique related to a liquid crystal display apparatus in which a screen is divided into a plurality of divided regions (backlight regions) and the emission brightness of a backlight and the transmittance of a liquid crystal panel are controlled for each divided region (for example, Japanese Patent Application Laid-open No. 2002-99250). With such a technique, for example, the emission brightness of the backlight in a divided region which displays a dark image is set to a low value and the emission brightness of the backlight in a divided region which displays a bright image is set to a high value. In addition, an image signal (transmittance of the liquid crystal panel) is corrected in accordance with the emission brightness of the backlight so that the brightness of an image displayed on a screen is the same between a case where light is emitted from the backlight at a predetermined emission brightness and a case where light is emitted from the backlight at an emission brightness which is based on the brightness of the image. Performing such control enables a misadjusted black level to be suppressed and the contrast to be enhanced.

FIG. 2 shows an example of an image to be displayed. The image shown in FIG. 2 includes a high brightness region (bright portion) with high brightness and a low brightness region (dark portion) with low brightness. With the conventional technique described above, when displaying the image shown in FIG. 2, uneven brightness occurs as shown in FIG. 3. Specifically, in a dark portion around a bright portion, a brightness gradient is created in which the closer a pixel is to the bright portion, the higher the brightness. An image displayed on a screen is shown in an upper half of FIG. 3. The lower half of FIG. 3 shows a brightness distribution on a dashed line A of the image shown in the upper half of FIG. 3. As is apparent from the brightness distribution shown in the lower half of FIG. 3, in a dark portion, a brightness gradient is created even if the emission brightness of the backlight is set to a low level. Such uneven brightness is created when backlight light (light emitted from the backlight) of a divided region is diffused and leaks to the surrounding divided regions. For example, backlight light is diffused by a diffuser plate.

In addition, when controlling the emission brightness for each divided region, the brightness of the backlight (for example, the brightness of light incident to a display panel; backlight brightness) may not always reach the necessary brightness. For example, in a divided region where the emission brightness of the surrounding divided regions is low, since the amount of backlight light that leaks from the surrounding divided regions (leakage light) is small, the backlight brightness may not always reach the necessary brightness. When the brightness of the backlight does not reach the necessary brightness, the reproducibility of the brightness of an image declines. In this case, in order to increase the reproducibility of brightness of an image, the emission brightness of a divided region in which the backlight brightness is insufficient or the emission brightness of the surrounding divided regions can conceivably be increased. However, controlling the emission brightness in this manner causes the brightness gradient described above to become steeper and increases a sense of interference (in other words, the image quality deteriorates).

SUMMARY OF THE INVENTION

The present invention provides a technique which enables reproducibility of the brightness of an image to be increased without causing a deterioration in image quality.

The present invention according to a first aspect provides an image display apparatus comprising:

a light-emitting unit capable of separately controlling the emission brightness in each of a plurality of divided regions in a screen;

a determining unit configured to determine a target brightness of a predetermined divided region, based on image data corresponding to the predetermined divided region;

an estimating unit configured to estimate the brightness of the predetermined divided region when light is emitted by the light-emitting unit at an emission brightness which is based on image data in each of the plurality of divided regions; and a control unit configured to control the emission brightness of two or more divided regions including the predetermined divided region based on a difference between the target brightness determined by the determining unit and the brightness estimated by the estimating unit.

The present invention according to a second aspect provides a control method for an image display apparatus including a light-emitting unit capable of separately controlling the emission brightness in each of a plurality of divided regions in a screen, the control method comprising:

determining a target brightness of a predetermined divided region, based on image data corresponding to the predetermined divided region;

estimating the brightness of the predetermined divided region when light is emitted by the light-emitting unit at an emission brightness which is based on image data in each of the plurality of divided regions; and controlling the emission brightness of two or more divided regions including the predetermined divided region based on a difference between the target brightness determined in the determining and the brightness estimated in the estimating.

According to the present invention, the reproducibility of the brightness of an image can be increased without causing a deterioration in image quality.

Further features of the present invention will become apparent from the following description of exemplary embodiments with reference to the attached drawings.

BRIEF DESCRIPTION OF THE DRAWINGS

FIG. 4 is a diagram showing an example of a characteristic value for each divided region;

FIG. 7 is a diagram showing an example of a distribution of the target brightness;

DESCRIPTION OF THE EMBODIMENTS

First Embodiment

Hereinafter, an image display apparatus and a control method thereof according to a first embodiment of the present invention will be described with reference to the drawings. In the present embodiment, for each divided region obtained by dividing a screen, the target brightness is determined based on a characteristic value of an input image signal (an image signal inputted to the image display apparatus). In consideration of leaking of backlight light (light from a backlight) in surrounding divided regions, brightness (brightness (luminance) of the backlight; backlight brightness) of each divided region when light is emitted from the backlight at a corresponding brightness, which is the emission brightness corresponding to a target brightness for each divided region, is estimated. Subsequently, when there is a divided region in which the estimated backlight brightness is lower than the target brightness, a value obtained by increasing the corresponding brightness of each divided region at a same increase rate is determined as the emission brightness of each divided region. Accordingly, the reproducibility of the brightness (luminance) of an image can be increased without causing an increase in uneven brightness (for example, a brightness gradient at a dark portion around a bright portion in which the closer to the bright portion, the higher the brightness), which is created by leaking of the backlight light of a divided region to surrounding divided regions. The backlight brightness is, for example, the brightness of light which is transmitted through an optical system, such as a diffuser plate and which is incident to a display panel. Specifically, the backlight brightness is the brightness on a rear surface of the display panel. Moreover, the backlight brightness may be the brightness at a position separated from the display panel. The target brightness is a target value of the backlight brightness. For example, the target brightness is the backlight brightness necessary for precisely reproducing the brightness of an image. Moreover, while an example of a case where the image display apparatus is a liquid crystal display apparatus will be described in the present embodiment, the image display apparatus is not limited to a liquid crystal display apparatus. The image display apparatus need only be an image display apparatus comprising a backlight and a display panel which transmits light from the backlight and which displays an image.

Figure 1:
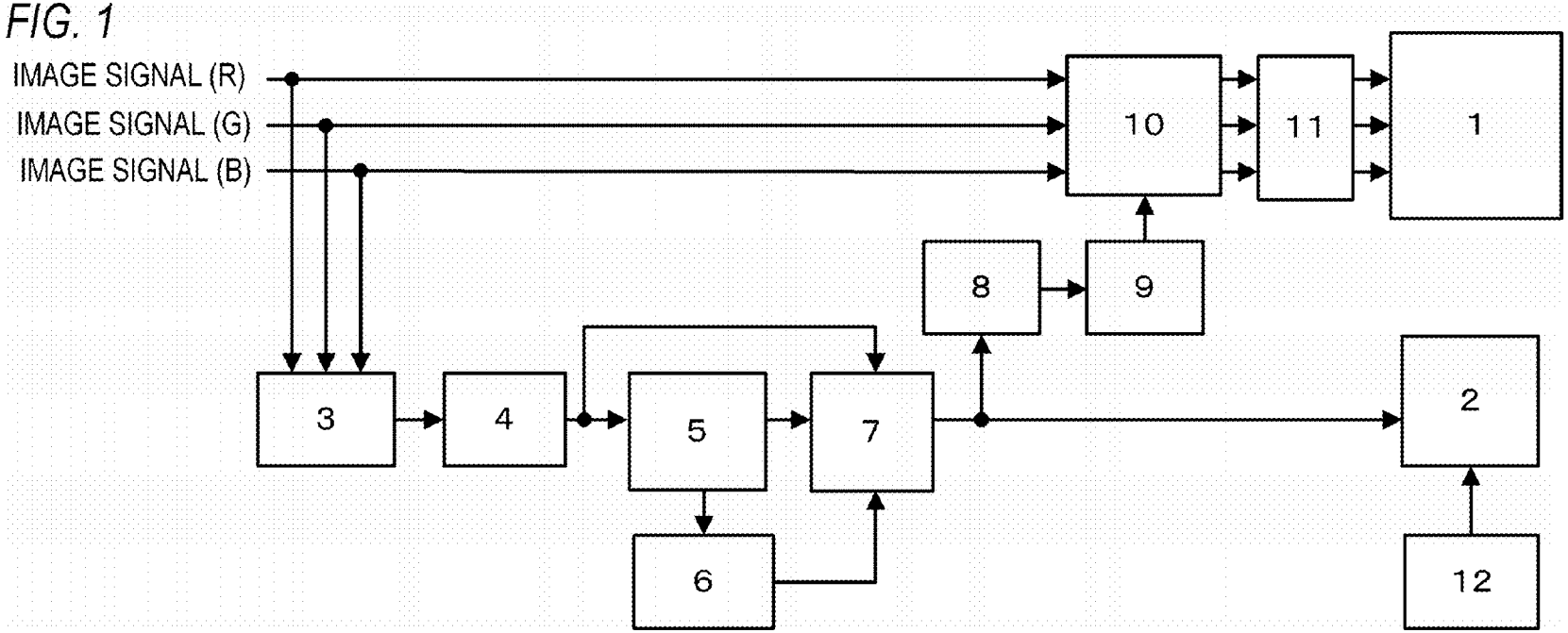
FIG. 1 is a block diagram showing an example of a functional configuration of an image display apparatus according to a first embodiment.

FIG. 1 is a block diagram showing an example of a functional configuration of an image display apparatus according to the present embodiment. In the example shown in FIG. 1, the image display apparatus comprises a liquid crystal module unit 1, a backlight module unit 2, a characteristic value acquiring unit 3, a target brightness determining unit 4, a backlight control value tentative determination unit 5, a brightness estimating unit 6, a backlight control value determining unit 7, a brightness distribution estimating unit 8, a correction coefficient calculating unit 9, a correction coefficient multiplying unit 10, a limit unit 11, a backlight power source unit 12, and the like.

The liquid crystal module unit 1 comprises a liquid crystal panel, a liquid crystal driver, a control board, and the like. The liquid crystal panel is a display panel which displays an image on a screen by transmitting backlight light that is light emitted from the backlight module unit 2 at a transmittance based on an input image signal (specifically, a transmittance in accordance with an image signal outputted from the limit unit 11). The liquid crystal panel includes a plurality of liquid crystal elements. The liquid crystal driver drives respective liquid crystal elements that constitute the liquid crystal panel. The control board controls the liquid crystal driver in accordance with an image signal.

The backlight module unit 2 comprises a backlight, a control circuit, an optical unit, and the like. The backlight is configured so as to be capable of controlling the emission brightness for each divided region. Specifically, the backlight has a light source for each divided region. The control circuit controls the respective light sources. The optical unit diffuses light from the respective light sources. In the present embodiment, it is assumed that the screen is divided into a total of 80 divided regions in an arrangement of ten divided regions in a horizontal direction by eight divided regions in a vertical direction. Moreover, the number of divided regions may be larger or smaller than 80. The control circuit causes the backlight to emit light at an emission brightness for each divided region determined by the backlight control value determining unit 7. Specifically, the control circuit receives a backlight control value for each divided region determined by the backlight control value determining unit 7 and causes the light source of each divided region to emit light at the received backlight control value.

Figure 2:
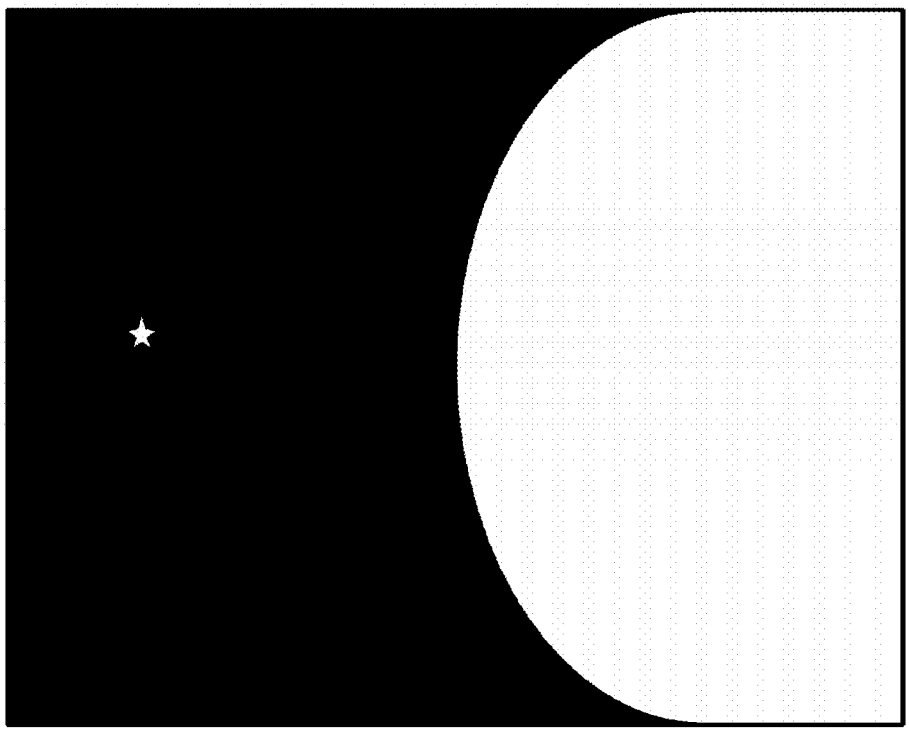
FIG. 2 is a diagram showing an example of an input image signal.
Figure 3:
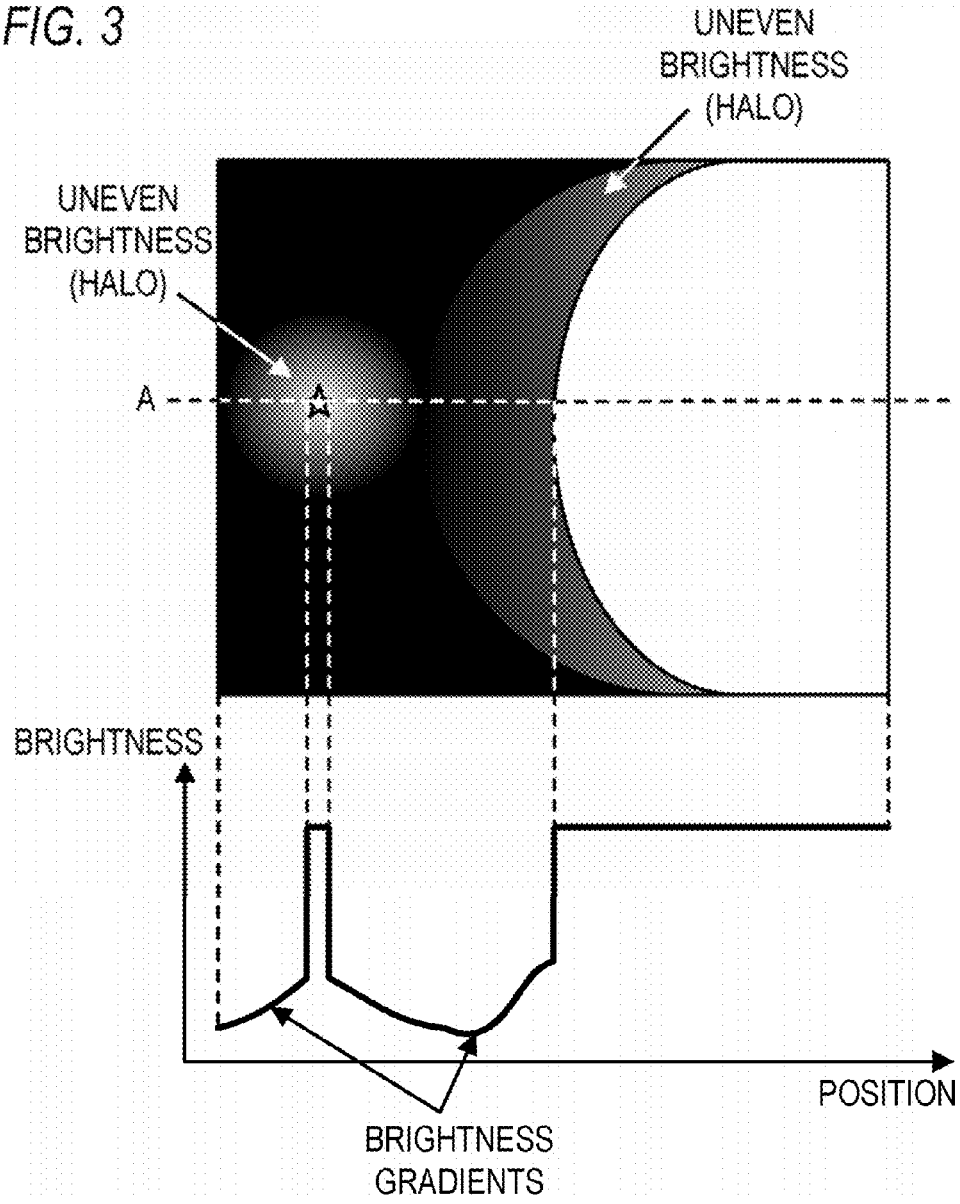
FIG. 3 is a diagram showing an example of an uneven brightness that is created when controlling the emission brightness for each divided region.

The characteristic value acquiring unit 3 acquires a characteristic value of an input image signal for each divided region. For example, the characteristic value acquiring unit 3 divides an input image signal into a plurality of image signals corresponding to the plurality of divided regions. In addition, for each divided region, the characteristic value acquiring unit 3 detects a characteristic value from the image signal corresponding to the divided region (an image signal displayed in the divided region). In the present embodiment, for each divided region, it is assumed that a maximum value of RGB signals (specifically, a maximum value among R values of respective pixels, G values of respective pixels, and B values of respective pixels) is detected as a characteristic value. FIG. 4 shows a characteristic value for each divided region in the case of the input image signal shown in FIG. 2. A region enclosed by bold lines in FIG. 4 represents a region of a screen, and regions obtained by dividing the region enclosed by bold lines using thin lines are divided regions. A number described inside a divided region represents a characteristic value of the divided region. Numbers described outside of the bold lines represent positions of the divided regions. The numbers 1 to 10 that are aligned in the horizontal direction represent horizontal positions of the divided regions. The numbers 1 to 8 that are aligned in the vertical direction represent vertical positions of the divided regions. In the present embodiment, it is assumed that the R values, the G values, and the B values may respectively assume values ranging from 0 to 255. In addition, it is assumed that the larger the R value, the G value, or the B value, the higher the brightness. As shown in FIG. 2, a region with a large area and high brightness exists in a right-side portion of an input image signal. Therefore, in the example shown in FIG. 4, a large number of divided regions with a characteristic value of 255 exist in the right half. In addition, a region with a small area and high brightness exists in a left-side portion of the input image signal. Therefore, in the example shown in FIG. 4, there is only one divided region with a characteristic value of 255 in the left half. Moreover, the a characteristic value may be acquired by analyzing an image or may be acquired from the outside. The characteristic value is not limited to a maximum value of RGB signals. The characteristic value may be a minimum value, a mode value, an intermediate value, an average value, a histogram, or the like of RGB signals. The characteristic value may be a representative value (a maximum value, a minimum value, a mode value, an intermediate value, an average value, or the like) or a histogram of brightness values (Y values). The characteristic value may be a representative value or a histogram of any of R values, G values, and B values. The characteristic value acquiring unit 3 outputs the characteristic value of each divided region to the target brightness determining unit 4.

Figure 5:
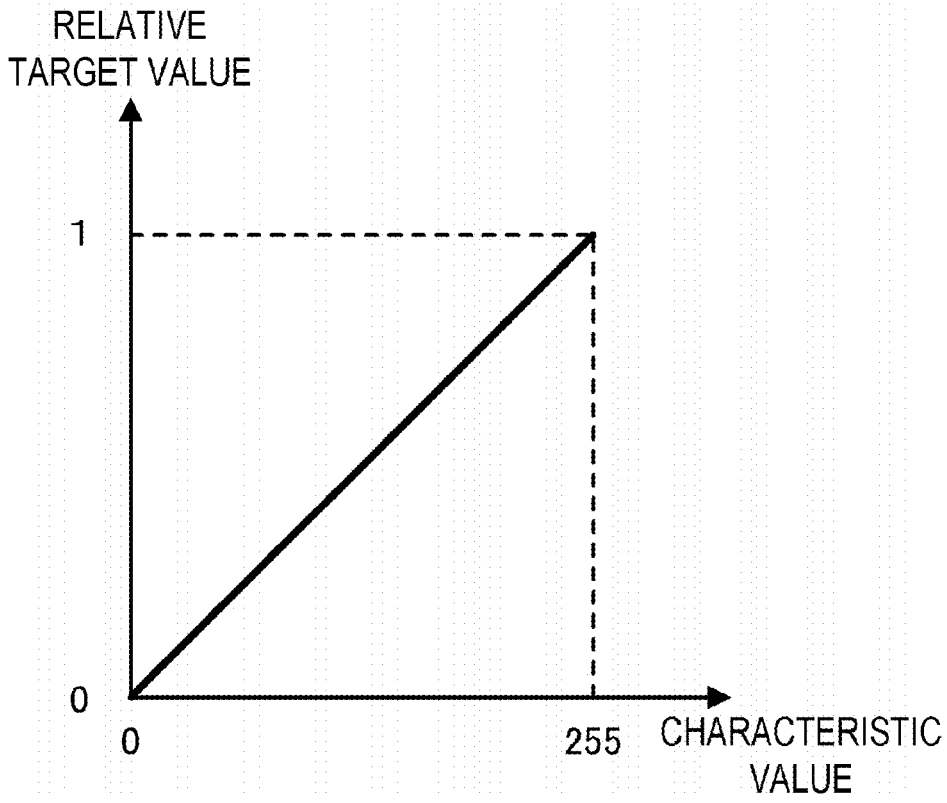
FIG. 5 is a diagram showing an example of a function which determines a relative target value.
Figure 6:
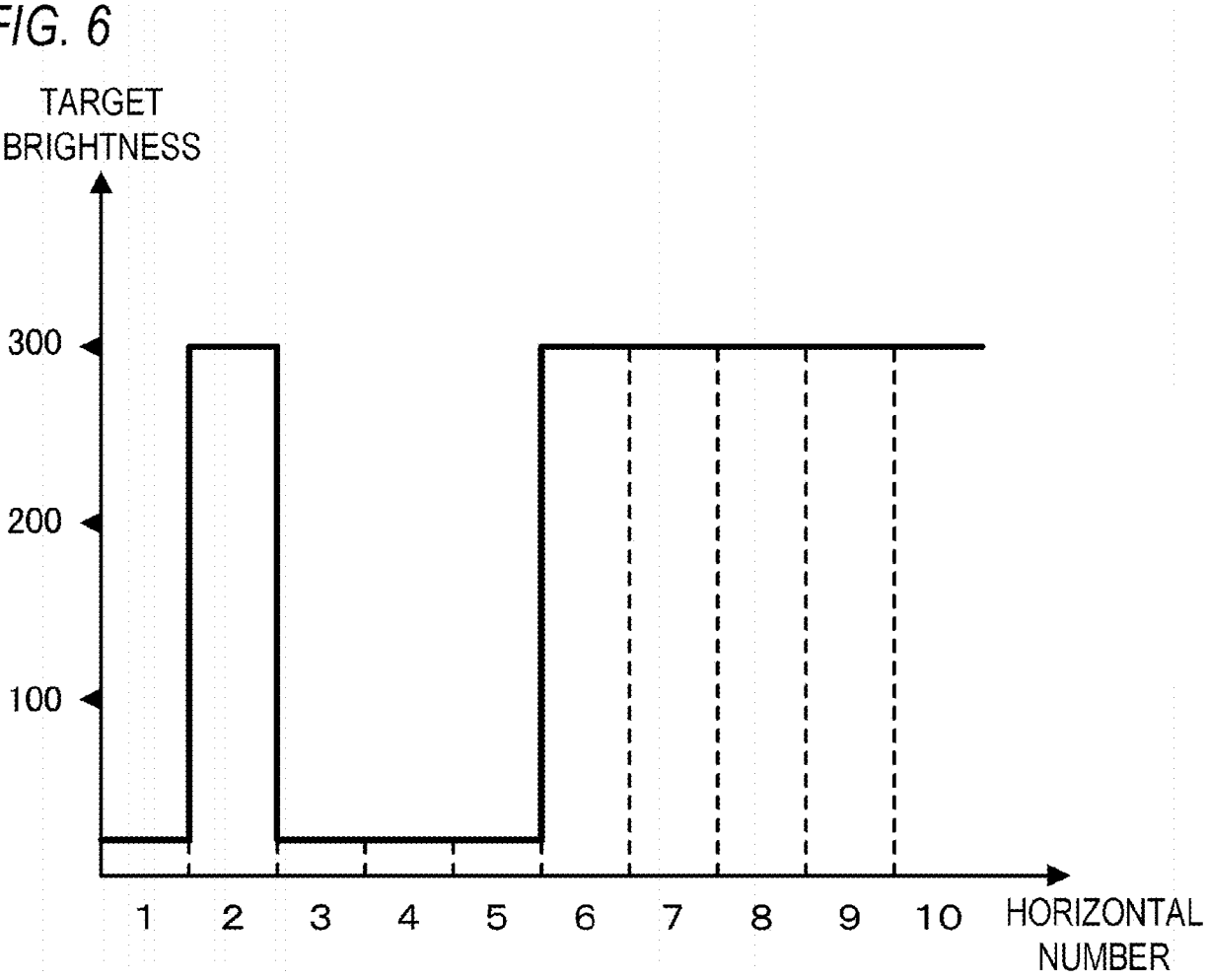
FIG. 6 is a diagram showing an example of a distribution of the target brightness.

The target brightness determining unit 4 determines the target brightness based on the characteristic value acquired (detected) by the characteristic value acquiring unit 3 for each divided region. In the present embodiment, the target brightness is determined as follows. First, for each divided region, a relative target value that is a relative value with respect to a target value corresponding to a characteristic value upper limit (255) (a target value normalized such that a target value corresponding to the characteristic value upper limit (255) becomes 1) is determined based on the characteristic value. For example, a relative target value is determined using a predetermined function. An example of the function is shown in FIG. 5. In FIG. 5, an abscissa represents characteristic value and an ordinate represents the relative target value. In the example shown in FIG. 5, the relative target value ranges from 0 to 1. In addition, in the example shown in FIG. 5, the relative target value increases linearly as the characteristic value increases. Moreover, the range of the relative target value is not limited to 0 to 1. For example, a lower limit of the relative target value may be greater than 0. In addition, the relative target value may vary non-linearly as the characteristic value varies. After the relative target value is set, a height of the actual target brightness is set in accordance with a set peak brightness value. Subsequently, the target brightness of each divided region is determined by increasing the relative target value of each divided region at a same increase rate so that the target brightness corresponding to the characteristic value upper limit (255) assumes a predetermined value. In the present embodiment, the predetermined value is set to 300 cd/m$^2$. The relative target value of each divided region is multiplied by 300 cd/m$^2$. For example, the predetermined value is backlight brightness in a case where emission brightness of the backlight is not controlled for each divided region (a case where emission brightness of all divided regions is set to a same value). FIG. 6 shows an example of a distribution of the target brightness determined with respect to divided regions in the fourth row (the ten divided regions whose number representing a vertical position is 4) in FIG. 4. In FIG. 6, an abscissa represents horizontal positions and an ordinate represents the target brightness. When the target brightness is determined by the method described above, as shown in FIG. 6, the divided regions with a characteristic value of 255 (the six divided regions whose numbers representing horizontal positions are 2, 6, 7, 8, 9, and 10) assume a target brightness of 300 cd/m$^2$. In addition, the divided regions with a characteristic value of 16 (the four divided regions whose numbers representing horizontal positions are 1, 3, 4, and 5) assume a target brightness of $300\times16/255\cong19$ cd/m$^2$. FIG. 7 shows the target brightness of each divided region determined based on the characteristic value of each divided region shown in FIG. 4. The target brightness determining unit 4 outputs the determined target brightness of each divided region to the backlight control value tentative determination unit 5 and the backlight control value determining unit 7.

The emission brightness for each divided region is determined (emission brightness determination) based on the target brightness of each divided region by the backlight control value tentative determination unit 5, the brightness estimating unit 6, and the backlight control value determining unit 7.

Figure 8:
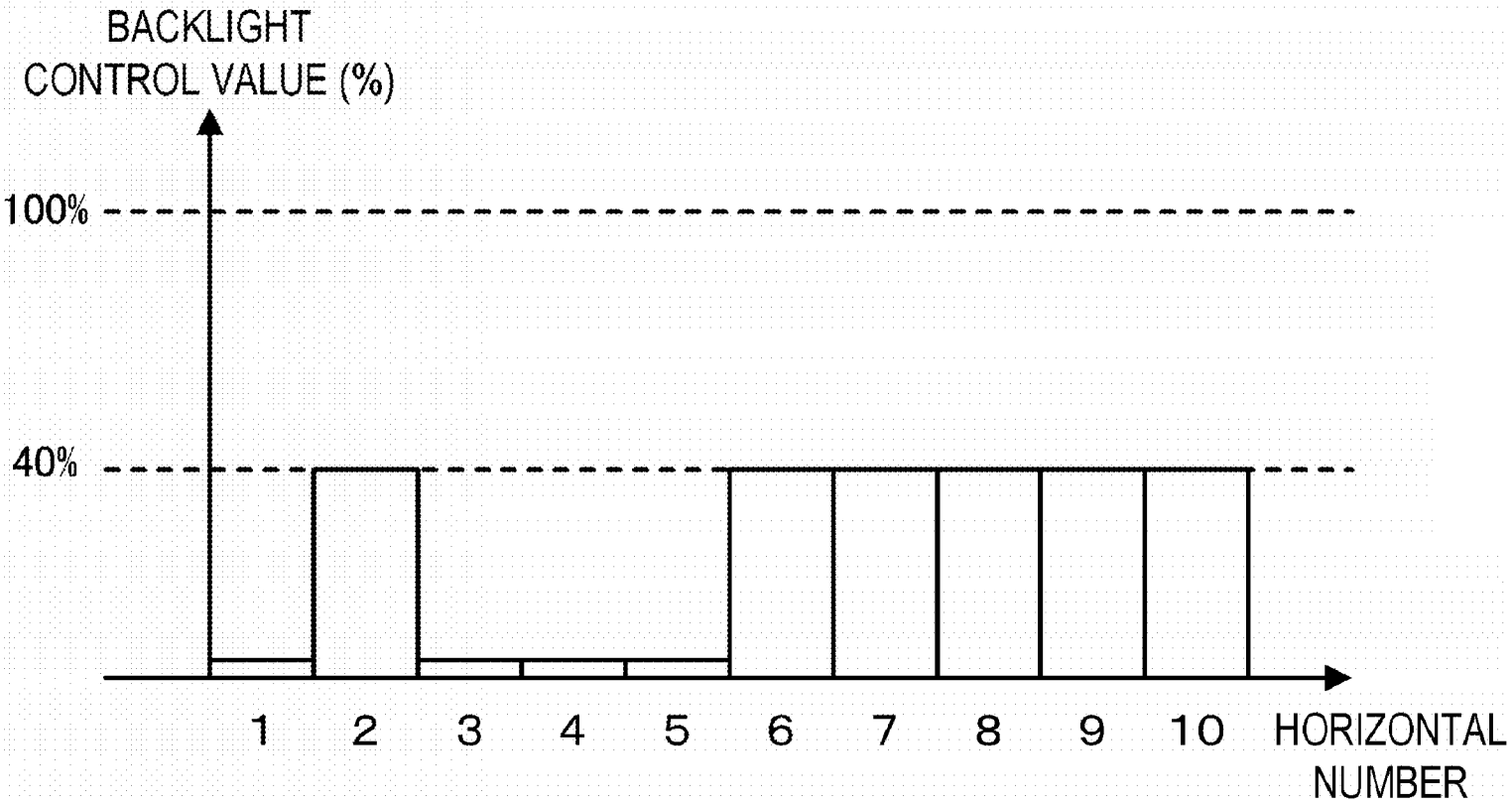
FIG. 8 is a diagram showing an example of a distribution of tentatively-determined backlight control values.

The backlight control value tentative determination unit 5 determines, for each divided region, a corresponding brightness that is the emission brightness corresponding to the target brightness determined by the target brightness determining unit 4. Specifically, the backlight control value tentative determination unit 5 determines, for each divided region, a backlight control value corresponding to the target brightness (a backlight control value for causing a light source to emit light at the corresponding brightness). In the present embodiment, the backlight control value tentative determination unit 5 tentatively determines a backlight control value using the target brightness and a backlight control value corresponding to a predetermined target brightness (the predetermined value described above; 300 cd/m$^2$). A backlight control value corresponding to the predetermined value (300 cd/m$^2$) is, for example, a backlight control value in a case where the emission brightness of the backlight is not controlled for each divided region. Therefore, a backlight control value of a divided region whose target brightness is the predetermined value (300 cd/m$^2$) assumes the same value as a backlight control value in a case where the emission brightness of the backlight is not controlled for each divided region. The backlight light of a divided region leaks to surrounding divided regions. Therefore, when light is emitted from the backlight so that the backlight brightness is consistent with the target brightness, the emission brightness of a divided region generally assumes a lower value than the target brightness. In the present embodiment, a backlight control value of each divided region is determined on the assumption that the backlight control value increases linearly as the target brightness increases. Moreover, a backlight control value may vary non-linearly as the target brightness varies. Moreover, a method of tentatively determining a backlight control value (corresponding brightness) is not limited to the method described above. For example, a backlight control value may be tentatively determined using a function or a table that represents a backlight control value for each target brightness value. In addition, a backlight control value corresponding to the target brightness (corresponding brightness) is not limited to a value obtained by the method described above. A backlight control value corresponding to the target brightness (corresponding brightness) may assume any value as long as the value is determined in accordance with the target brightness or a characteristic value. FIG. 8 shows an example of a distribution of backlight control values determined (tentatively determined) with respect to the divided regions in the fourth row in FIG. 6. In FIG. 8, an abscissa represents horizontal positions and an ordinate represents backlight control values. A backlight control value ranges from 0% to 100%. In the present embodiment, a backlight control value corresponding to the predetermined value (300 cd/m$^2$) is set to 40%. Therefore, the divided regions with a target brightness of 300 cd/m$^2$ (the six divided region whose numbers representing horizontal positions are 2, 6, 7, 8, 9, and 10) assume a backlight control value of 40%. In addition, the divided regions with the target brightness of 19 cd/m$^2$ (the four divided regions whose numbers representing horizontal positions are 1, 3, 4, and 5) assume a backlight control value of 40×19/300=2.53%. The backlight control value tentative determination unit 5 outputs the tentatively-determined backlight control value for each divided region to the brightness estimating unit 6 and the backlight control value determining unit 7.

Figure 9:
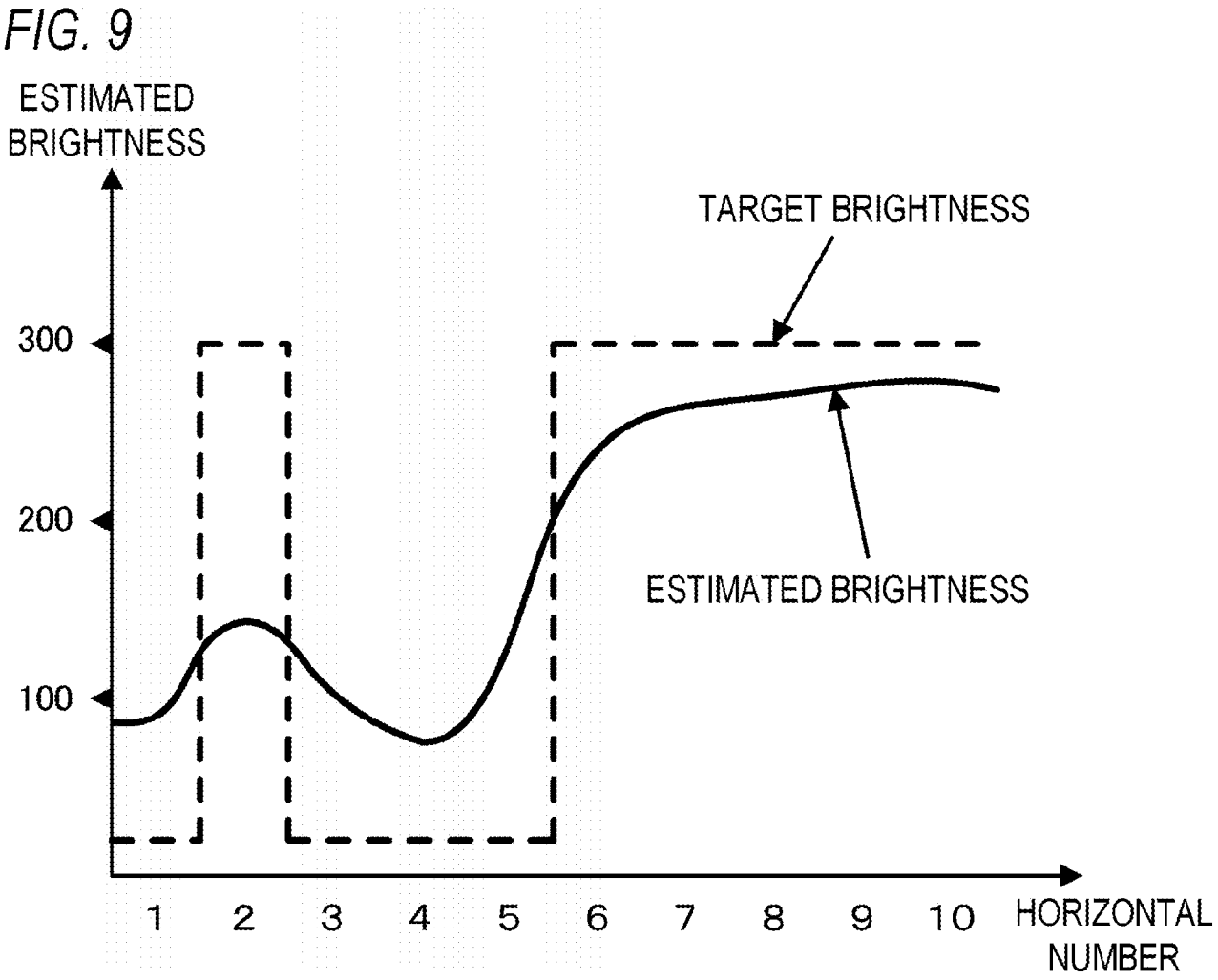
FIG. 9 is a diagram showing an example of a distribution of the estimated brightness.

The brightness estimating unit 6 estimates the backlight brightness of each divided region when light is emitted from the backlight at a corresponding brightness determined by the backlight control value tentative determination unit 5 for each divided region in consideration of the leakage of the backlight light of surrounding divided regions. In the present embodiment, for each divided region, the brightness estimating unit 6 estimates the backlight brightness at a center position of the divided region. Specifically, a table representing attenuation coefficients of the backlight light of each divided region for each center position is stored in advance as attenuation information in a memory (not shown). For each center position, the corresponding brightness of the backlight light of each divided region is multiplied by an attenuation coefficient. Specifically, for each center position, the backlight control value of each divided region tentatively determined by the backlight control value tentative determination unit 5 is multiplied by an attenuation coefficient (a transform coefficient that transforms a backlight control value into the backlight brightness). In addition, for each center position, a summation of multiplication results of the respective divided regions is calculated as the estimated brightness. Moreover, attenuation information is not limited to the table described above. Attenuation information may be a function that represents a relationship between the distance from a divided region and an attenuation coefficient. When the relationship between the distance from a divided region and an attenuation coefficient is the same among divided regions, preparing one function may suffice. Moreover, the estimated brightness is not limited to the backlight brightness at a center position of a divided region. For example, a representative value of the backlight brightness at a plurality of positions in one divided region may be used as estimated brightness. FIG. 9 shows an example of an estimation result obtained by the brightness estimating unit 6 when a tentatively-determined backlight control value is a value shown in FIG. 8. In FIG. 9, an abscissa represents horizontal positions and an ordinate represents estimated brightness. In FIG. 9, a bold line represents an estimation result. In addition, for comparison, the target brightness determined by the target brightness determining unit 4 is depicted by a dashed line in FIG. 9. FIG. 9 shows a curve that smoothly connects estimated brightness (backlight brightness at center positions) as an estimation result. A brightness distribution when light is emitted from the backlight at corresponding a brightness for each divided region (distribution of the backlight brightness) is approximately consistent with a distribution that is represented by such a curve. When controlling the emission brightness for each divided region, the amount of leakage light (backlight light that leaks from surrounding divided regions) may decrease as compared to a case where the emission brightness is not controlled for each divided region. Since reduced leakage light results in a lower backlight brightness, as shown in FIG. 9, there may exist divided regions where the estimated brightness is lower than the target brightness. The brightness estimating unit 6 outputs an estimation result (estimated brightness for each divided region) to the backlight control value determining unit 7.

Figure 10:
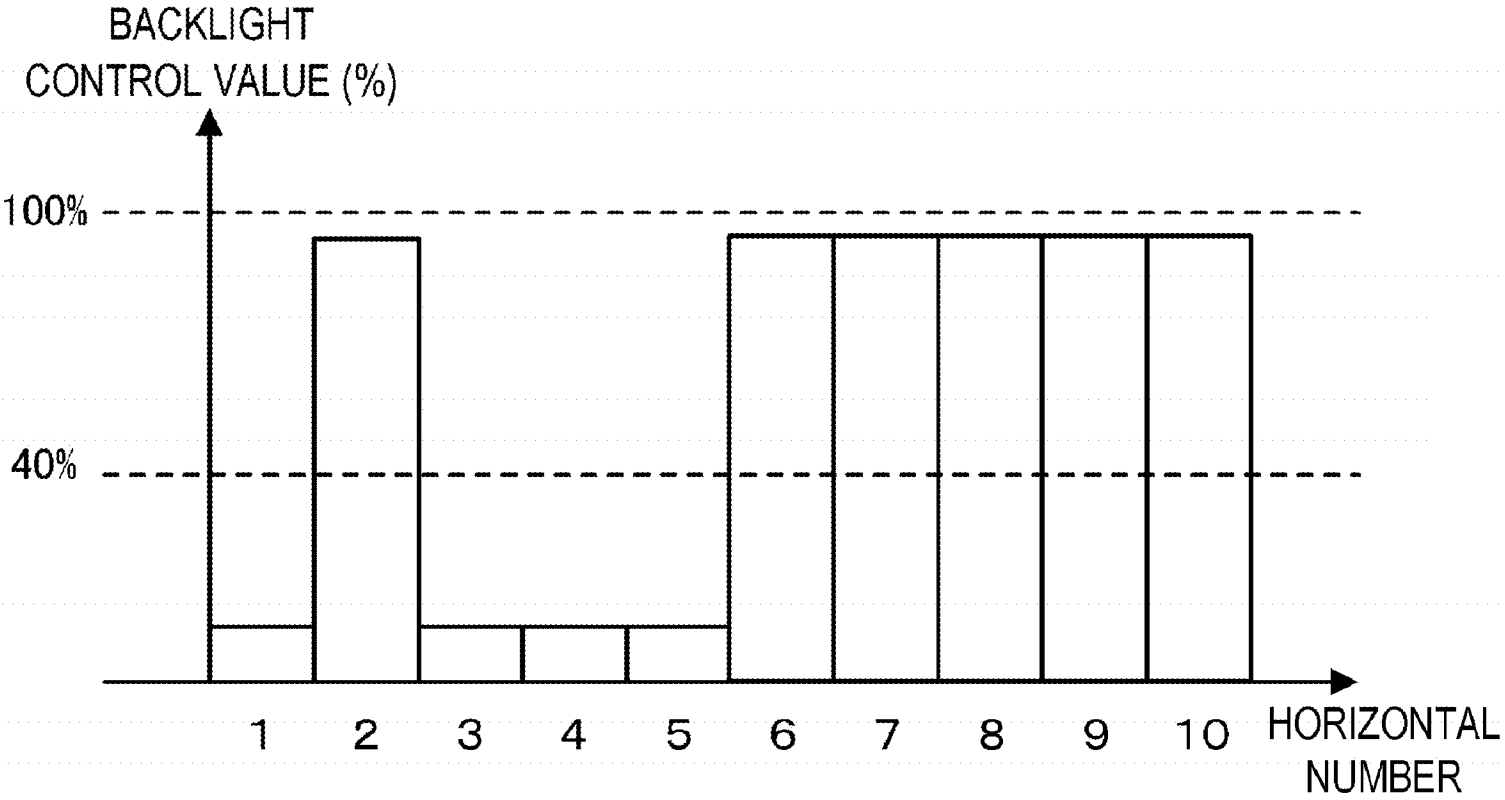
FIG. 10 is a diagram showing an example of a distribution of determined backlight control values.
Figure 11:
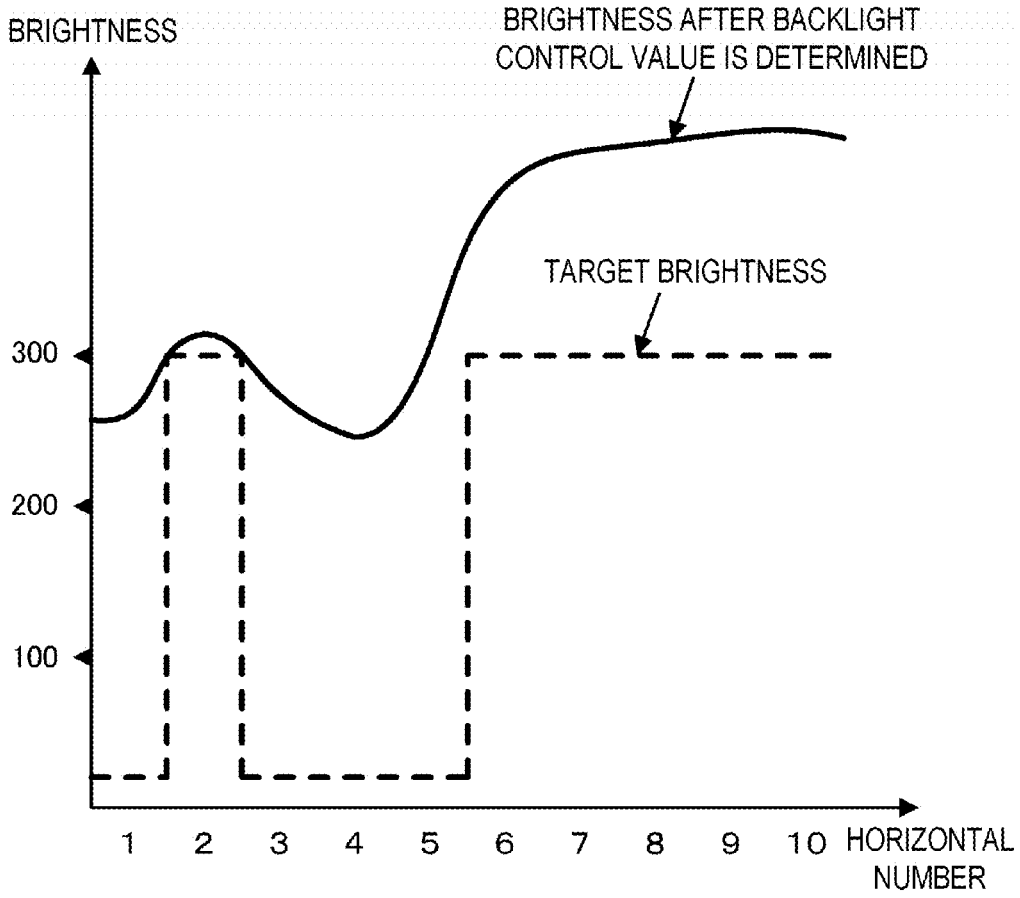
FIG. 11 is a diagram showing an example of a distribution of the backlight brightness.

The backlight control value determining unit 7 determines, for each divided region, whether or not the estimated brightness estimated by the brightness estimating unit 6 is lower than the target brightness determined by the target brightness determining unit 4. Subsequently, when there is a divided region whose estimated brightness is determined to be lower than the target brightness, the backlight control value determining unit 7 determines a value obtained by increasing the corresponding brightness of each divided region at the a same increase rate as the emission brightness of each divided region. Specifically, when there is a divided region whose estimated brightness is determined to be lower than the target brightness, the backlight control value determining unit 7 determines a value obtained by increasing a tentatively-determined backlight control value of each divided region at the same increase rate as the backlight control value of each divided region. The corresponding brightness of each divided region is increased at the same increase rate because increasing the corresponding brightness of only a part of the divided regions increases uneven brightness. For example, a brightness gradient that is created between a divided region with increased corresponding brightness and surrounding divided regions becomes steep and causes uneven brightness to increase. In the present embodiment, by increasing the corresponding brightness of each divided region at the same increase rate, the brightness distribution when light is emitted from the backlight at corresponding brightness of each divided region is maintained. Therefore, an increase in uneven brightness (a steeper brightness gradient) can be prevented. Moreover, when a divided region whose estimated brightness is determined to be lower than the target brightness does not exist, the backlight control value determining unit 7 may or may not determine the tentatively-determined backlight control value of each divided region as the backlight control value of each divided region. For example, when a divided region whose estimated brightness is determined to be lower than the target brightness does not exist, a backlight control value determined in advance may be determined as the backlight control value of each divided region. When the target brightness and the estimated brightness assume the values shown in FIG. 9, the estimated brightness of the six divided region whose numbers representing horizontal positions (horizontal numbers) are 2, 6, 7, 8, 9, and 10 does not reach the target brightness. In addition, the divided region with a maximum difference between the estimated brightness and the target brightness is the divided region with the horizontal number 2. Specifically, the estimated brightness of the divided region with the horizontal number 2 is 140 and the target brightness thereof is 300. In other words, the target brightness of the divided region with the horizontal number 2 is 2.14 (≅300/140) times the estimated brightness. Therefore, in the present embodiment, the tentatively-determined backlight control value of each divided region is increased at an increase rate equal to or greater than 2.14 so that the backlight brightness of the divided region with the horizontal number 2 equals or exceeds the target brightness. In this case, the increase rate is set "equal to or greater than" 2.14 because the estimated brightness is backlight brightness at a center position of a divided region and, as is apparent from FIG. 9, the backlight brightness may be lower at edges of a divided region than at the center of the divided region. In the present embodiment, the emission brightness of each divided region is determined so that the backlight brightness at all positions in a screen becomes equal to or higher than the target brightness. Specifically, the corresponding brightness is increased at an increase rate that is higher than a ratio of the target brightness to the estimated brightness on the assumption that the backlight brightness is lower at the edges of a divided region than at the center of the divided region. Accordingly, regardless of where a pixel requiring the target brightness exists in a divided region, the brightness of an image can be precisely reproduced. To what degree the increase rate is set higher than the ratio of the target brightness to the estimated brightness can be determined based on, for example, diffusion characteristics of the backlight light. Specifically, when diffusion of the backlight light is wide, the increase rate may be set higher than a case where the diffusion of the backlight light is narrow. In the present embodiment, the corresponding brightness is increased at an increase rate that is 10% higher than the ratio of the target brightness to the estimated brightness. In other words, the corresponding brightness of each divided region is multiplied by 2.35 (≅2.14×1.1). FIG. 10 shows backlight control values determined by increasing the backlight control values shown in FIG. 8. FIG. 11 shows a brightness distribution (backlight brightness distribution) when light is emitted from the backlight at the backlight control values shown in FIG. 10. As shown in FIG. 10, the six divided regions whose horizontal numbers are 2, 6, 7, 8, 9, and 10 assume a backlight control value of 40%×2.35≅94%. In addition, the backlight brightness when light is emitted from the backlight at the backlight control values shown in FIG. 10 equals or exceeds the target brightness at all positions in the screen. Furthermore, since the corresponding brightness of each divided region is increased at the same increase rate, the shape of the brightness distribution shown in FIG. 11 is consistent with the shape of the brightness distribution shown in FIG. 9. For a position where the backlight brightness has exceeded the target brightness, the brightness of an image can be precisely reproduced by lowering transmittance of the display panel in accordance with an excess amount. The backlight control value determining unit 7 outputs the determined backlight control value of each divided region to the brightness distribution estimating unit 8 and the backlight module unit 2.

The brightness distribution estimating unit 8 estimates a brightness distribution when light is emitted from the backlight at the emission brightness determined by the backlight control value determining unit 7 for each divided region in consideration of the leakage of backlight light of surrounding divided regions. An estimating method is the same as the estimation method used by the brightness estimating unit 6. Moreover, a position to be estimated is not limited to a center position of a divided region. The backlight brightness may be estimated for all positions in the screen by a method similar to the estimation method used by the brightness estimating unit 6. The backlight brightness may be estimated for one or more positions in each divided region by a method similar to the estimation method used by the brightness estimating unit 6. In addition, for positions where the backlight brightness is not estimated by a method similar to the estimation method used by the brightness estimating unit 6, the backlight brightness may be estimated by interpolation using the estimated backlight brightness. The brightness distribution estimating unit 8 outputs an estimated result (estimated brightness of each position) to the correction coefficient calculating unit 9.

The correction coefficient calculating unit 9 and the correction coefficient multiplying unit 10 correct an input image signal based on the brightness distribution estimated by the brightness distribution estimating unit 8.

The correction coefficient calculating unit 9 obtains, for each position (pixel position) in the screen, a correction coefficient of an image signal based on the brightness distribution estimated by the brightness distribution estimating unit 8. Subsequently, the correction coefficient calculating unit 9 outputs a correction coefficient of each position to the correction coefficient multiplying unit 10. The correction coefficient is used to compensate for a variation in on-screen brightness (brightness of a displayed image) due to a difference between the backlight brightness and the target brightness. Specifically, for a position where the backlight brightness is lower than the target brightness, a correction coefficient that increases the brightness of the input image signal is calculated, and for a position where the backlight brightness is higher than the target brightness, a correction coefficient that reduces the brightness of the input image signal is calculated. If estimated brightness at a given position is denoted by Lpn and a target value of the backlight brightness (which differs from the target brightness described above) when adjusting an input image signal using a correction coefficient is denoted by Lt, then a correction coefficient Gpn can be calculated according to Equation 1 below. The target value Lt is, for example, the backlight brightness (300 cd/m$^2$) when the emission brightness of the backlight is not controlled for each divided region. The target value Lt may be determined for each divided region.

$$Gpn=Lt/Lpn \quad \text{(Equation 1)}$$

The correction coefficient multiplying unit 10 corrects an input image signal for each position by multiplying the input image signal by the correction coefficient determined by the correction coefficient calculating unit 9. In addition, the correction coefficient multiplying unit 10 outputs the corrected image signal to the limit unit 11. Moreover, when there is a position where the backlight brightness has not been estimated, the correction coefficient multiplying unit 10 estimates the backlight brightness by interpolation.

The limit unit 11 performs a limiting process that limits values so as to fall within an input range of the liquid crystal module unit 1 when there is a pixel in the image signal corrected by the correction coefficient multiplying unit 10 whose value exceeds the input range. In addition, the limit unit 11 outputs the image signal after the limiting process to the liquid crystal module unit 1. The backlight power source unit 12 supplies the necessary voltage and the necessary current to the backlight module unit 2.

As described above, according to the present embodiment, when there is a divided region whose backlight brightness is lower than the target brightness, a value obtained by increasing the corresponding brightness of each divided region at the same increase rate is determined as the emission brightness of each divided region. Accordingly, the reproducibility of brightness of an image can be increased without causing deterioration in image quality. Moreover, while the present embodiment adopts a configuration where the emission brightness of each divided region is determined so that the brightness at all positions in a screen equals or exceeds the target brightness, this configuration is not restrictive. For example, when the target brightness and the estimated brightness assume the values shown in FIG. 9, the increase rate may be higher or lower than 2.14. By increasing the corresponding brightness of each divided region at the same increase rate, the backlight brightness can be brought closer to the target brightness. As a result, the reproducibility of brightness of an image can be increased.

Second Embodiment

Hereinafter, an image display apparatus and a control method thereof according to a second embodiment of the present invention will be described with reference to the drawings. In the first embodiment, a tentatively-determined backlight control value of each divided region is increased at the same increase rate. However, generally, there is an upper limit to the amount of current that can be supplied to a backlight by a power source. Therefore, the amount of current necessary for emitting light from the backlight at the backlight control value determined by the backlight control value determining unit 7 may sometimes exceed a maximum current amount that can be supplied to the backlight. For example, when there are many divided regions with high backlight control values, the amount of current that is required for each unit time may exceed the maximum current amount that can be supplied to the backlight. In consideration thereof, the present embodiment calculates the required current amount which is the amount of current that is required in order to emit light from the backlight at the backlight control value for each divided region determined by the backlight control value determining unit 7. In addition, a determination is made on whether or not the required current amount is greater than a predetermined current amount (for example, the maximum current amount described earlier). When it is determined that the required current amount is greater than the predetermined current amount, there is a risk that the required current amount may exceed the maximum current amount described earlier. Therefore, when it is determined that the required current amount is greater than the predetermined current amount, an adjustment process for adjusting the determined emission brightness of each divided region is performed so that the required current amount equals or falls below the predetermined current amount. In the present embodiment, when the required current amount may potentially exceed the predetermined current amount described above, a divided region whose target brightness differs from those of a surrounding divided region by a threshold or more is detected as an isolated high-brightness region. In addition, the emission brightness of divided regions surrounding the detected isolated high-brightness region is increased while the emission brightness of other divided regions is reduced so that the required current amount equals or falls below the predetermined current amount described above and the backlight brightness of each divided region equals or exceeds the target brightness. In the present embodiment, the corresponding brightness of divided regions surrounding an isolated high-brightness region is increased. Accordingly, the backlight brightness of the isolated high-brightness region when light is emitted from the backlight at corresponding brightness of each divided region increases. As a result, the increase rate that is used by the backlight control value determining unit 7 to determine the emission brightness is reduced. The reduction in the increase rate enables the emission brightness of divided regions other than the divided regions surrounding the isolated high-brightness region to be reduced. As a result, the required current amount can be reduced. Moreover, increasing the emission brightness of divided regions surrounding the isolated high-brightness region causes an increase in uneven brightness (a brightness gradient near the divided regions surrounding the isolated high-brightness region becomes steep). However, since such an increase in uneven brightness only occurs when the required current amount exceeds the predetermined current amount described above, this is not that big of a problem. When the required current amount does not exceed the predetermined current amount described above, the effects of suppressing deterioration of image quality and enhancing the reproducibility of the brightness of an image can be produced in a similar manner to the first embodiment.

Figure 12:
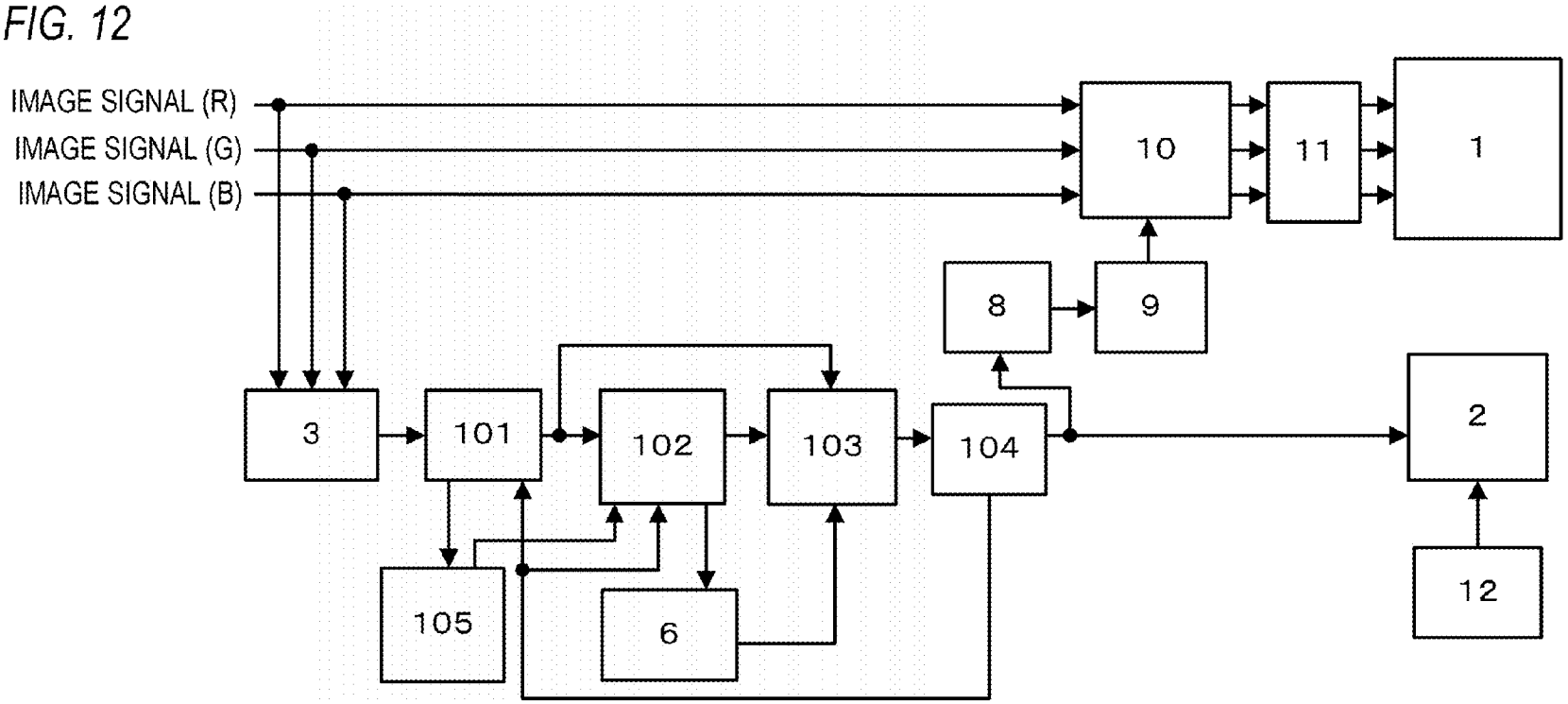
FIG. 12 is a block diagram showing an example of a functional configuration of an image display apparatus according to a second embodiment.

FIG. 12 is a block diagram showing an example of a functional configuration of an image display apparatus according to the present embodiment. In the example shown in FIG. 12, the image display apparatus comprises a liquid crystal module unit 1, a backlight module unit 2, a characteristic value acquiring unit 3, a target brightness determining unit 101, a backlight control value tentative determination unit 102, a brightness estimating unit 6, a backlight control value determining unit 103, a current amount calculating unit 104, an isolated high-brightness region detecting unit 105, a brightness distribution estimating unit 8, a correction coefficient calculating unit 9, a correction coefficient multiplying unit 10, a limit unit 11, a backlight power source unit 12, and the like.

Since the liquid crystal module unit 1, the backlight module unit 2, the characteristic value acquiring unit 3, the brightness estimating unit 6, the brightness distribution estimating unit 8, the correction coefficient calculating unit 9, the correction coefficient multiplying unit 10, the limit unit 11, and the backlight power source unit 12 are the same as those of the first embodiment, descriptions thereof will be omitted.

The target brightness determining unit 101 determines the target brightness of each divided region in a similar manner to the target brightness determining unit 4 according to the first embodiment. In addition, when the current amount calculating unit 104 (to be described later) determines that a required current amount is greater than a predetermined current amount, the target brightness determining unit 101 receives a current limit flag which means that the required current amount must be reduced. Furthermore, only when a current limit flag is received, the target brightness determining unit 101 outputs data representing the target brightness of each divided region to the isolated high-brightness region detecting unit 105 and causes the isolated high-brightness region detecting unit 105 to detect an isolated high-brightness region.

Figure 13:
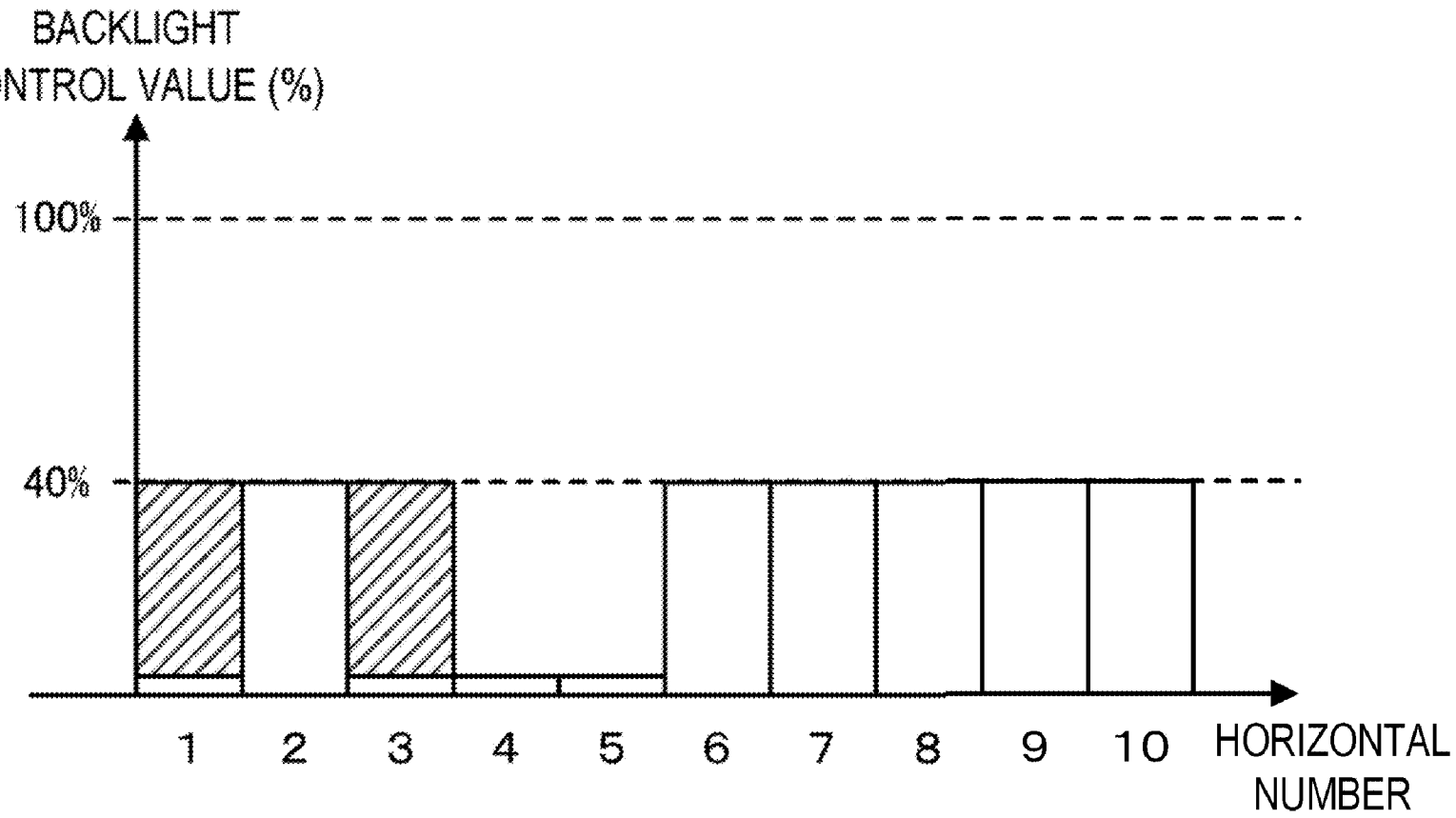
FIG. 13 is a diagram showing an example of an adjustment result of tentatively-determined backlight control values.

The backlight control value tentative determination unit 102 tentatively determines a backlight control value (corresponding brightness) of each divided region in a similar manner to the backlight control value tentative determination unit 5 according to the first embodiment. In addition, when the current amount calculating unit 104 (to be described later) determines that the required current amount is greater than the predetermined current amount, the backlight control value tentative determination unit 102 receives a current limit flag. When a current limit flag is received, the backlight control value tentative determination unit 102 receives region information indicating an isolated high-brightness region from the isolated high-brightness region detecting unit 105 (to be described later). When region information is received, the backlight control value tentative determination unit 102 increases corresponding brightness of divided regions surrounding the isolated high-brightness region (divided regions within a set range from the isolated high-brightness region). In the present embodiment, the corresponding brightness of divided regions adjacent to the isolated high-brightness region is increased to the same value as the corresponding brightness of the isolated high-brightness region. FIG. 13 is a diagram showing an example of an adjustment result of corresponding brightness (tentatively-determined backlight control values) shown in FIG. 8. As shown in FIG. 6, the target brightness of a divided region represented by (horizontal number, vertical number)=(2, 4) is significantly higher than the target brightness of divided regions adjacent thereto. Therefore, the isolated high-brightness region detecting unit 105 (to be described later) detects the divided region at the position (2, 4) as an isolated high-brightness region. In addition, as indicated by hatched lines in FIG. 13, the backlight control value tentative determination unit 102 increases backlight control values of the two divided regions at the position (1, 4) and the position (3, 4) to a same value (40%) as the backlight control value of the divided region at the position (2, 4). Furthermore, when a current limit flag is received two or more times during processing of a single frame or image, the backlight control value tentative determination unit 102 increases the number of divided regions for which the backlight control value is increased each time a current limit flag is received. Specifically, the set range described earlier is expanded and the number of divided regions that are defined as divided regions surrounding the isolated high-brightness region is increased. Moreover, although not shown, backlight control values of divided regions adjacent not only in the horizontal direction but also in the vertical direction and a diagonal direction are favorably also increased. Accordingly, brightness gradients in the horizontal direction, the vertical direction, and the diagonal direction may be set equal to one another. In addition, while the present embodiment adopts a configuration in which divided regions that exist within a range of one divided region from an isolated high-brightness region or, in other words, divided regions adjacent to the isolated high-brightness region are defined as surrounding divided regions in a first process, this configuration is not restrictive. For example, when an area of a divided region is small with respect to an area of the screen, divided regions that exist within a range of a plurality of divided regions from an isolated high-brightness region may be defined as surrounding divided regions in the first process. The backlight control value tentative determination unit 102 outputs the tentatively-determined backlight control value of each divided region (when adjustment of the backlight control value has been performed, the backlight control value after adjustment) to the brightness estimating unit 6 and the backlight control value determining unit 103.

Figure 14:
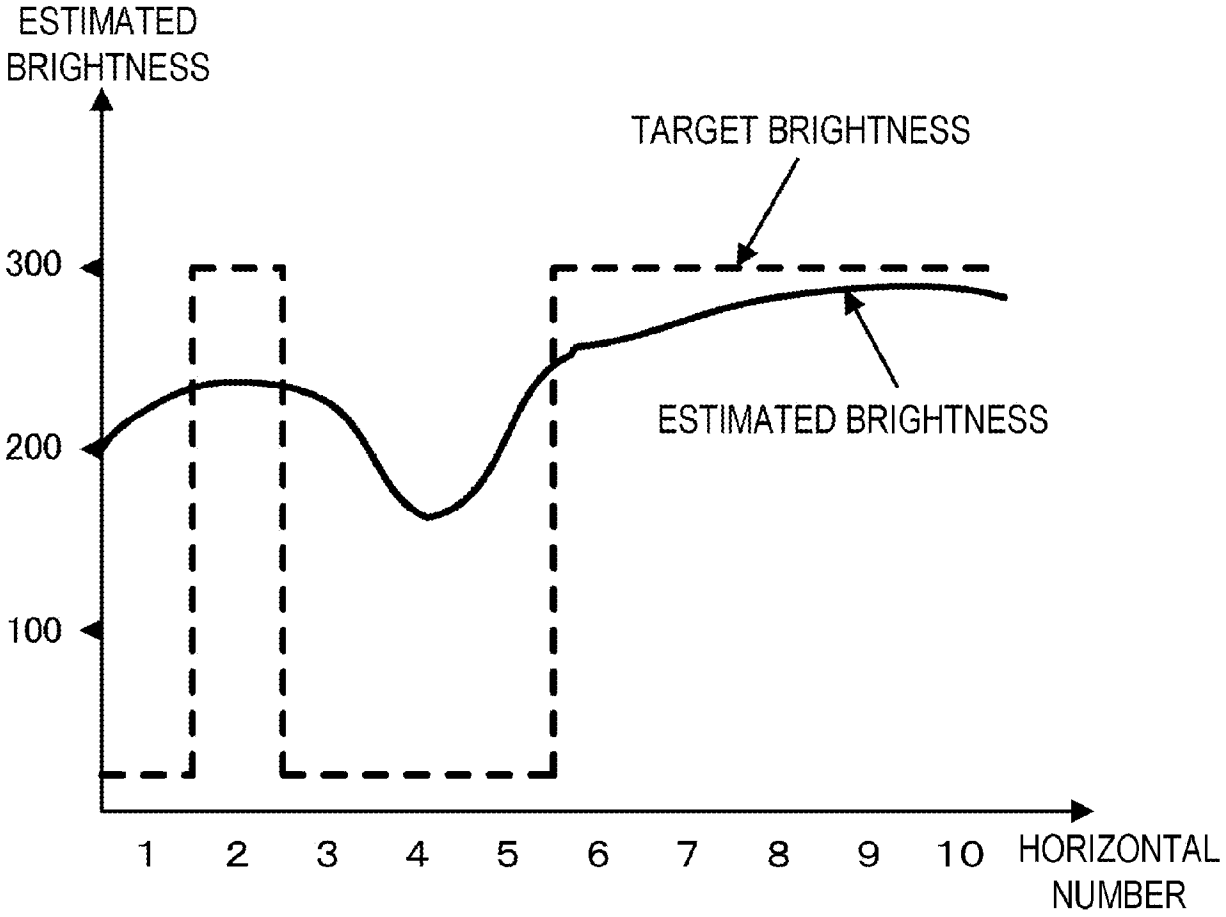
FIG. 14 is a diagram showing an example of the estimated brightness obtained from backlight control values after adjustment.
Figure 15:
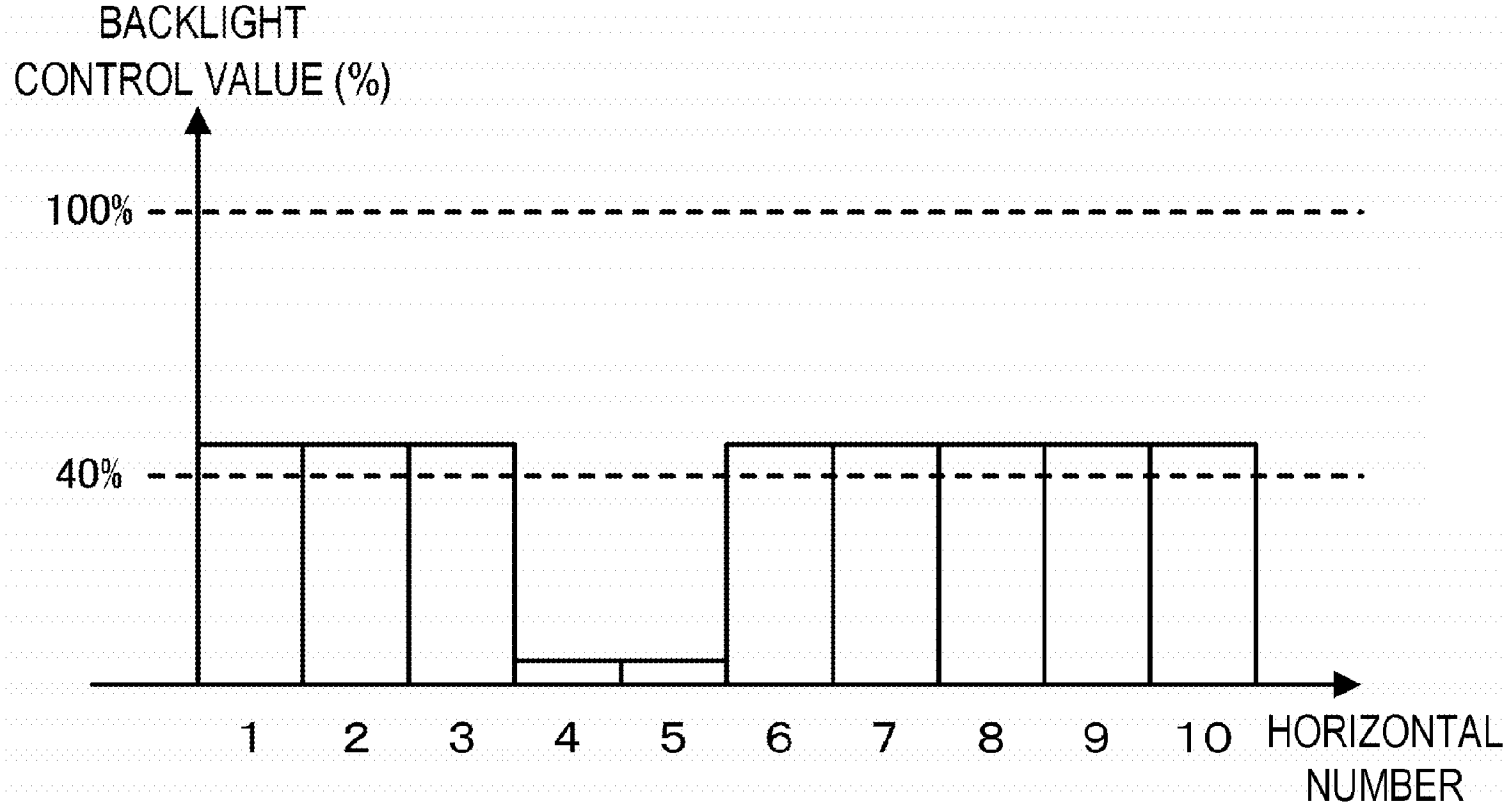
FIG. 15 is a diagram showing an example of a distribution of determined backlight control values.

The backlight control value determining unit 103 determines whether or not estimated brightness is lower than the target brightness in a similar manner to the backlight control value determining unit 7 according to the first embodiment. Subsequently, when there is a divided region whose estimated brightness is determined to be lower than the target brightness, the backlight control value determining unit 103 determines a value obtained by increasing the corresponding brightness of each divided region at the same increase rate as the emission brightness of each divided region. When the tentatively-determined backlight control value is adjusted as shown in FIG. 13, the estimated brightness obtained from the adjusted backlight control value assumes a value shown in FIG. 14. In the example shown in FIG. 14, the estimated brightness and the target brightness of the divided region with a horizontal number of 2 are smaller than in FIG. 9. This is because an increase in the backlight control values (corresponding brightness) of horizontal numbers 1 and 3 has caused an increase in leakage light to the divided region with the horizontal number 2. In the example shown in FIG. 14, the estimated brightness of the divided region with the horizontal number 2 is 240 and the target brightness thereof is 300. In other words, the target brightness of the divided region with the horizontal number 2 is 1.25 (≅300/240) times the estimated brightness. Therefore, the backlight control value determining unit 103 multiplies the corresponding brightness of each divided region by 1.37 (≅1.25×1.1) in a similar manner to the first embodiment. FIG. 15 shows backlight control values determined by increasing the backlight control values shown in FIG. 13. FIG. 15 shows that backlight control values of the divided regions surrounding the isolated high-brightness region are higher and the backlight control values of other divided regions are lower than in FIG. 10. It is also shown that a maximum value of the backlight control values is suppressed to around half of the case shown in FIG. 10. The required current amount can be reduced by reducing the maximum value or the total value of the backlight control values. The backlight control value determining unit 103 outputs the determined backlight control value of each divided region to the current amount calculating unit 104.

The current amount calculating unit 104 calculates a required current amount that the backlight power source unit 12 is to supply to the backlight module unit 2 based on the backlight control value of each divided region determined by the backlight control value determining unit 103. In addition, the current amount calculating unit 104 determines whether or not the calculated required current amount is greater than a predetermined current amount (threshold). The required current amount exceeds the threshold because controlling the emission brightness for each divided region requires a larger amount of current to be instantaneously supplied as compared to a case where the emission brightness is not controlled for each divided region. Moreover, the probability of the required current amount exceeding the threshold can be reduced if components of the power source and the backlight are designed so that a large current can be instantaneously supplied. However, designing components of the power source and the backlight so that a large current can be instantaneously supplied causes an increase in component cost and substrate size (for example, an area thereof). When it is determined that the required current amount is greater than the predetermined current amount, the current amount calculating unit 104 outputs a current limit flag to the target brightness determining unit 101, the backlight control value tentative determination unit 102, and the isolated high-brightness region detecting unit 105. Subsequently, adjustment of the tentatively-determined backlight control value is repetitively performed until the required current amount is determined to be equal to or lower than the predetermined current amount. When the required current amount is determined to be equal to or lower than the predetermined current amount, the current amount calculating unit 104 outputs the backlight control value of each divided region (finally) determined by the backlight control value determining unit 103 to the brightness distribution estimating unit 8 and the backlight module unit 2.

The isolated high-brightness region detecting unit 105 receives the target brightness of each divided region from the target brightness determining unit 101 and detects an isolated high-brightness region. In the present embodiment, for each divided region, the target brightness of the divided region is compared with the target brightness of four divided regions (adjacent regions) that are adjacent to above, below, the left, and the right of the divided region. Subsequently, a divided region having three or more adjacent regions whose target brightness differs by a predetermined threshold or more is detected as an isolated high-brightness region candidate. Among divided regions detected as candidates, a divided region having four or more adjacent regions whose target brightness differs by a predetermined threshold or more is detected as an isolated high-brightness region. In addition, when two divided regions respectively having three adjacent regions whose target brightness differs by a predetermined threshold or more are adjacent to each other, the two divided regions are detected as isolated high-brightness regions. When two divided regions respectively having three adjacent regions whose target brightness differs by a predetermined threshold or more are not adjacent to each other, the two divided regions are not detected as isolated high-brightness regions. The isolated high-brightness region detecting unit 105 outputs an isolated high-brightness region detection result (information indicating a position of an isolated high-brightness region) to the backlight control value tentative determination unit 102. Moreover, while a predetermined fixed value is used as the threshold of the target brightness difference in the present embodiment, this configuration is not restrictive. The threshold may be set for each scene based on a characteristic value such as an APL of an input image signal. Moreover, when a current limit flag is outputted twice or more from the current amount calculating unit 104 during processing of a single frame or image, a process for detecting an isolated high-brightness region (an isolated high-brightness region detection process) is to be performed twice or more on the single frame or image. The isolated high-brightness region detecting unit 105 may lower the threshold of the target brightness difference each time an isolated high-brightness region detection process is performed so that a divided region is more readily determined to be an isolated high-brightness region. Moreover, a method of detecting an isolated high-brightness region is not limited to the method described above. An isolated high-brightness region may be detected by any method as long as a divided region with a large target brightness difference from surrounding divided regions can be detected as an isolated high-brightness region. For example, the target brightness of a divided region that is a target of determination regarding whether or not the divided region is an isolated high-brightness region may be compared with the target brightness of a larger number of divided regions than the four adjacent regions described above. The target brightness of a divided region that is a target of determination regarding whether or not the divided region is an isolated high-brightness region may be compared with an average value of target values of surrounding divided regions. An isolated high-brightness region may be detected using a characteristic value instead of the target brightness.

As described above, according to the present embodiment, when the required current amount is greater than the predetermined current amount, the emission brightness of each divided region determined by the backlight control value determining unit 103 is adjusted so that the required current amount equals or falls below the predetermined current amount. Accordingly, the required current amount can be prevented from exceeding the predetermined current amount. In addition, in the present embodiment, the emission brightness of divided regions surrounding an isolated high-brightness region is increased while the emission brightness of other divided regions is reduced so that the required current amount equals or falls below the predetermined current amount and the brightness of each divided region equals or exceeds the target brightness. Accordingly, even when the required current amount is limited, reproducibility of brightness of an image can be increased.

Moreover, when the required current amount is greater than the predetermined current amount, the emission brightness of each divided region determined by the backlight control value determining unit 103 may be lowered at a same lowering rate so that the required current amount equals or falls below the predetermined current amount. Moreover, while adjustment of the tentatively-determined backlight control value is to be repetitively performed until the required current amount is determined to be equal to or lower than the predetermined current amount in the present embodiment, this configuration is not restrictive. When the required current amount does not equal or fall below the predetermined current amount even when an adjustment process is repetitively performed a predetermined number of times on a single frame or image, a value determined in advance so that the required current amount equals or falls below the predetermined current amount may be adopted as the emission brightness of each divided region. When the required current amount does not equal or fall below the predetermined current amount even when an adjustment process is repetitively performed a predetermined number of times on a single frame or image, light may be emitted from the backlights of all divided regions at the same emission brightness. Moreover, while the present embodiment adopts a configuration in which corresponding brightness of divided regions surrounding an isolated high-brightness region is increased to corresponding brightness of the isolated high-brightness region, this configuration is not restrictive. The corresponding brightness after adjustment of the divided regions surrounding an isolated high-brightness region may be higher or lower than the corresponding brightness of the isolated high-brightness region. The degree of increase of the corresponding brightness may be determined based on a difference between the required current amount and the predetermined current amount. In addition, while the present embodiment adopts a configuration in which corresponding brightness of divided regions surrounding an isolated high-brightness region is increased, this configuration is not restrictive. For example, the backlight control value determining unit 103 may increase the emission brightness of the divided regions surrounding an isolated high-brightness region and reduce the emission brightness of other divided regions.

Third Embodiment

Hereinafter, an image display apparatus and a control method thereof according to a third embodiment of the present invention will be described. In the second embodiment, a first adjustment process is to be repetitively performed until the required current amount is determined to be equal to or lower than the predetermined current amount. The first adjustment process is a process in which the emission brightness of divided regions surrounding an isolated high-brightness region is increased while the emission brightness of other divided regions is reduced so that the required current amount equals or falls below the predetermined current amount and the brightness of each divided region equals or exceeds the target brightness. However, the first adjustment process on a single frame is not always completed within a period of the frame. Therefore, in the present embodiment, a second adjustment process is performed in addition to the first adjustment process after the required current amount is determined to be greater than the predetermined current amount and until changing of scenes of an input image signal that is inputted in frame units. The second adjustment process is a process in which the emission brightness of each divided region determined by the backlight control value determining unit 103 is lowered at a same lowering rate so that the required current amount equals or falls below the predetermined current amount. Since the second adjustment process can be performed in a short period of time, a result of the second adjustment process on a single frame can be adopted as a backlight control value of the frame. In addition, when a frame for which the first adjustment process has been completed does not exist among frames inputted after the required current amount is determined to be greater than the predetermined current amount and until the present, the result of the second adjustment process on a present frame is adopted as the emission brightness of each divided region with respect to the present frame. When a frame for which the first adjustment process has been completed exists among frames inputted after the required current amount is determined to be greater than the predetermined current amount and until the present, a latest result of the first adjustment process is adopted as the emission brightness of each divided region with respect to the present frame. For example, when the first adjustment process on the present frame has not been completed and the first adjustment process on the immediately previous frame has been completed, the result of the first adjustment process on the immediately previous frame is adopted as the emission brightness of each divided region with respect to the present frame. Accordingly, even if the first adjustment process on a single frame is not completed within the period of the frame, the required current amount can be prevented from exceeding the predetermined current amount. Moreover, in the present embodiment, the first adjustment process is performed for each frame.

Figure 16:
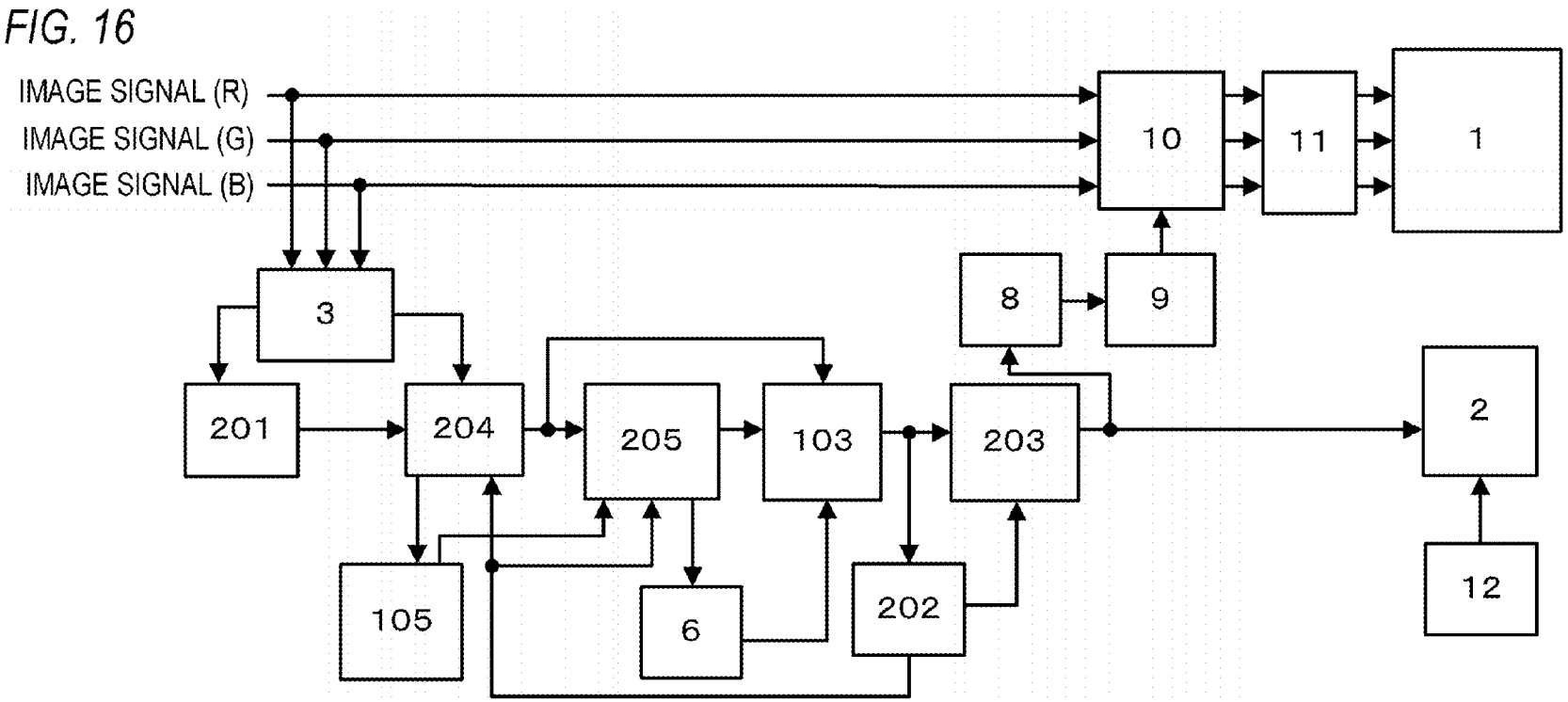
FIG. 16 is a block diagram showing an example of a functional configuration of an image display apparatus according to a third embodiment.

FIG. 16 is a block diagram showing an example of a functional configuration of an image display apparatus according to the present embodiment. In the example shown in FIG. 16, the image display apparatus comprises a liquid crystal module unit 1, a backlight module unit 2, a characteristic value acquiring unit 3, a target brightness determining unit 204, a scene change detecting unit 201, a backlight control value tentative determination unit 205, a brightness estimating unit 6, a backlight control value determining unit 103, a current amount calculating unit 202, a backlight control value limiting unit 203, an isolated high-brightness region detecting unit 105, a brightness distribution estimating unit 8, a correction coefficient calculating unit 9, a correction coefficient multiplying unit 10, a limit unit 11, a backlight power source unit 12, and the like. Since the liquid crystal module unit 1, the backlight module unit 2, the characteristic value acquiring unit 3, the brightness estimating unit 6, the backlight control value determining unit 103, the isolated high-brightness region detecting unit 105, the brightness distribution estimating unit 8, the correction coefficient calculating unit 9, the correction coefficient multiplying unit 10, the limit unit 11, and the backlight power source unit 12 are the same as those of the first and second embodiments, descriptions thereof will be omitted.

The scene change detecting unit 201 detects changing of scenes in an input image signal. The changing of scenes in an input image signal may be detected by any method. In the present embodiment, the scene change detecting unit 201 counts the number of divided regions whose characteristic value has varied by a predetermined value or more between an immediately previous frame and a present frame, and determines that scenes have been switched when the count result is equal to or greater than a predetermined threshold. A determination is made on whether scenes on the screen are switched and whether the brightness distribution of the backlight varies significantly. When the scene change detecting unit 201 detects changing of scenes in an input image signal, the scene change detecting unit 201 outputs a scene change flag indicating that a changing of scenes has occurred to the target brightness determining unit 204 and the current amount calculating unit 202.

The current amount calculating unit 202 calculates a required current amount and determines whether or not the required current amount is greater than a predetermined current amount in a similar manner to the current amount calculating unit 104 according to the second embodiment. In addition, when the current amount calculating unit 202 determines that the required current amount is greater than the predetermined current amount, the current amount calculating unit 202 calculates an excess amount as a difference between the required current amount and the predetermined current amount. An excess amount is a ratio of a value obtained by subtracting the predetermined current amount from the required current amount to the predetermined current amount. In addition, when the current amount calculating unit 202 determines that the required current amount is greater than the predetermined current amount, the current amount calculating unit 202 outputs a current limit flag and an excess amount to the backlight control value limiting unit 203 and outputs only the current limit flag to the target brightness determining unit 101 and the backlight control value tentative determination unit 205. However, when it is determined in one scene that the required current amount is equal to or smaller than the predetermined current amount after it is determined that the required current amount is greater than the predetermined current amount, the current amount calculating unit 202 does not output a current limit flag and an excess amount to the backlight control value limiting unit 203 until a changing of scenes occurs. Instead, the current amount calculating unit 202 outputs a backlight control value of each divided region when the required current amount had last been determined to be equal to or smaller than the predetermined current amount (a value determined by the backlight control value determining unit 103; a result of the first adjustment process) to the backlight control value limiting unit 203. In addition, when it is determined that the required current amount is equal to or smaller than the predetermined current amount, the current amount calculating unit 202 outputs the backlight control value of each divided region determined by the backlight control value determining unit 103 to the backlight control value limiting unit 203. Moreover, a method of calculating an excess amount is not limited to the method described above. An excess amount can be calculated by subtracting the predetermined current amount from the required current amount.

Figure 17:
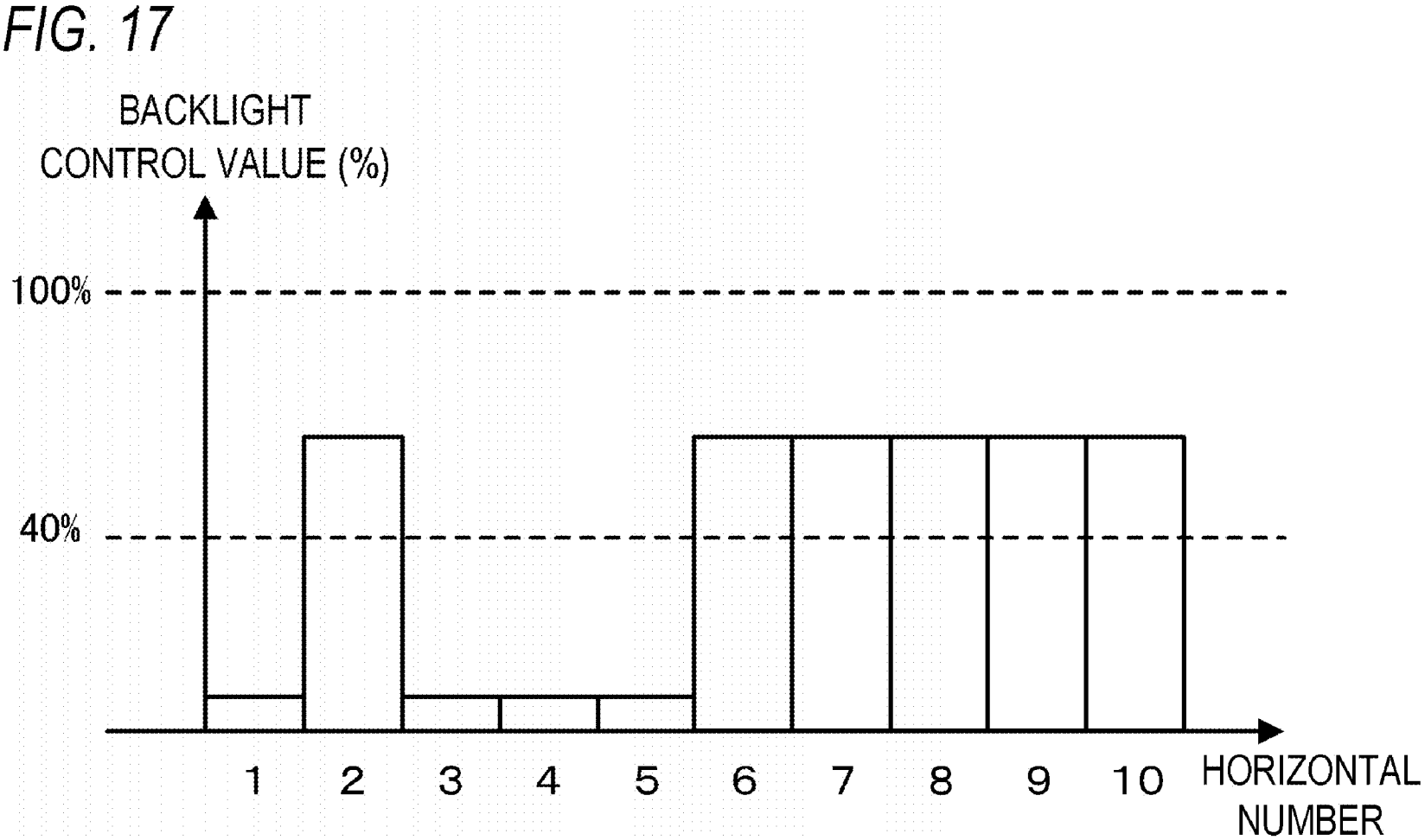
FIG. 17 is a diagram showing an example of a result of a second adjustment process.

When a current limit flag and an excess amount has been inputted, the backlight control value limiting unit 203 lowers the backlight control value of each divided region determined by the backlight control value determining unit 103 (inputted from the backlight control value determining unit 103) at a same lowering rate (second process). Moreover, the backlight control value of each divided region determined by the backlight control value determining unit 103 may be a value prior to the first adjustment process or a value determined during the first adjustment process. The lowering rate is determined in accordance with an excess amount. For example, when the backlight control value is the value shown in FIG. 10 and the excess amount is 20%, a backlight control value of each divided region is reduced by 20% or more. In the present embodiment, it is assumed that a backlight control value is reduced by the excess amount+5% in order to provide the required current amount with flexibility. In addition, the backlight control value limiting unit 203 outputs a result of the second process to the brightness distribution estimating unit 8 and the backlight module unit 2. Furthermore, when a backlight control value of each divided region determined by the backlight control value determining unit 103 is inputted from the current amount calculating unit 202 instead of a current limit flag and an excess amount, the backlight control value limiting unit 203 outputs the backlight control value of each divided region to the brightness distribution estimating unit 8 and the backlight module unit 2. FIG. 17 shows a result of the second adjustment process when the backlight control value has the value shown in FIG. 10. While a maximum value of the backlight control values is 94% in FIG. 10, a maximum value of the backlight control values is 94×0.75=70.5% in FIG. 17. Since the backlight control value decreases in this manner, the backlight brightness falls below the target brightness and an image that is dark as a whole is displayed. However, in a similar manner to the second embodiment, adjustment of the backlight control value tentatively determined by the backlight control value tentative determination unit 205 is performed and a backlight control value such as that shown in FIG. 15 is inputted from the current amount calculating unit 202 after a few frames (after one or two frames). Therefore, the period of time during which the overall dark image is displayed is short and a sense of interference caused by a one-time display of a dark image is small. As described above, when it is determined in one scene that the required current amount is equal to or smaller than the predetermined current amount after it is determined that the required current amount is greater than the predetermined current amount, a result of an immediately previous first adjustment process is outputted from the current amount calculating unit 202 to the backlight control value limiting unit 203 until a changing of scenes occurs. Therefore, when a frame for which the first adjustment process has been completed does not exist among frames inputted after the required current amount is determined to be greater than the predetermined current amount and until the present, the backlight control value limiting unit 203 adopts and outputs the result of the second adjustment process on a present frame as the emission brightness of each divided region with respect to the present frame. In addition, when a frame for which the first adjustment process has been completed exists among frames inputted after the required current amount is determined to be greater than the predetermined current amount and until the present, the backlight control value limiting unit 203 adopts and outputs a latest result of the first adjustment process as the emission brightness of each divided region with respect to the present frame. When adopted results are frequently switched between a result of the first adjustment process and a result of the second adjustment process in one scene, a dark image is frequently displayed and a flicker is likely to occur. In the present embodiment, due to the configuration described above, adopted results are no longer frequently switched between a result of the first adjustment process and a result of the second adjustment process and an occurrence of a flicker can be suppressed.

The target brightness determining unit 204 determines the target brightness of each divided region in a similar manner to the target brightness determining unit 101 according to the second embodiment, and when a current limit flag is received, the target brightness determining unit 204 outputs a target brightness value to the isolated high-brightness region detecting unit 105. However, in the present embodiment, after a current limit flag is received and until a scene change flag is received, the target brightness determining unit 204 continuously transmits the target brightness to the isolated high-brightness region detecting unit 105 so that the first adjustment process is performed. When a scene change flag is received from the scene change detecting unit 201, the target brightness determining unit 204 suspends transmission of the target brightness to the isolated high-brightness region detecting unit 105. Accordingly, the first adjustment process is continuously executed after a current limit flag is received and until a scene change flag is received.

The backlight control value tentative determination unit 205 tentatively determines or adjusts a backlight control value (corresponding brightness) of each divided region in a similar manner to the backlight control value tentative determination unit 102 according to the second embodiment. In addition, in the present embodiment, the target brightness is continuously inputted to the isolated high-brightness region detecting unit 105 after a current limit flag is received and until a scene change flag is received. Therefore, after a current limit flag is received and until a scene change flag is received, an isolated high-brightness region detection result is continuously inputted to the backlight control value tentative determination unit 205. When an isolated high-brightness region detection result is being inputted, the backlight control value tentative determination unit 205 performs a backlight control value adjustment process (a process of increasing a backlight control value of divided regions surrounding an isolated high-brightness region when the required current amount is greater than the predetermined current amount). As a result, the first adjustment process is performed after a current limit flag is created and until a scene change flag is created. When an isolated high-brightness region detection result is no longer inputted, the backlight control value tentative determination unit 205 tentatively determines and outputs a backlight control value corresponding to a present frame (corresponding brightness) by a method similar to that of the first embodiment. Moreover, in the present embodiment, when the first adjustment process on a single frame is not completed within the period of the frame, a displacement is created between a frame that is a target of the first adjustment process and a frame that adopts a result of the first adjustment process. However, since a variation of an image in one scene is small, deterioration of image quality due to such a displacement between frames is negligible.

As described above, according to the present embodiment, when a frame for which the first adjustment process has been completed does not exist among frames inputted after the required current amount is determined to be greater than the predetermined current amount and until the present, the result of the second adjustment process on a present frame is adopted as the emission brightness of each divided region with respect to the present frame. In addition, when a frame for which the first adjustment process has been completed exists among frames inputted after the required current amount is determined to be greater than the predetermined current amount and until the present, a latest result of the first adjustment process is adopted as the emission brightness of each divided region with respect to the present frame. Accordingly, even if the first adjustment process on a single frame is not completed within the period of the frame, the required current amount can be prevented from exceeding the predetermined current amount. Moreover, the present embodiment is configured such that only the first adjustment process is a process of adjusting the emission brightness of each divided region based on a difference between the required current amount and the predetermined current amount. However, this configuration is not restrictive. At least one of the first adjustment process and the second adjustment process may be a process of adjusting the emission brightness of each divided region based on a difference between the required current amount and the predetermined current amount. Alternatively, at least both of the first adjustment process and the second adjustment process may not be a process of adjusting the emission brightness of each divided region based on a difference between the required current amount and the predetermined current amount.

Fourth Embodiment

Figure 18:
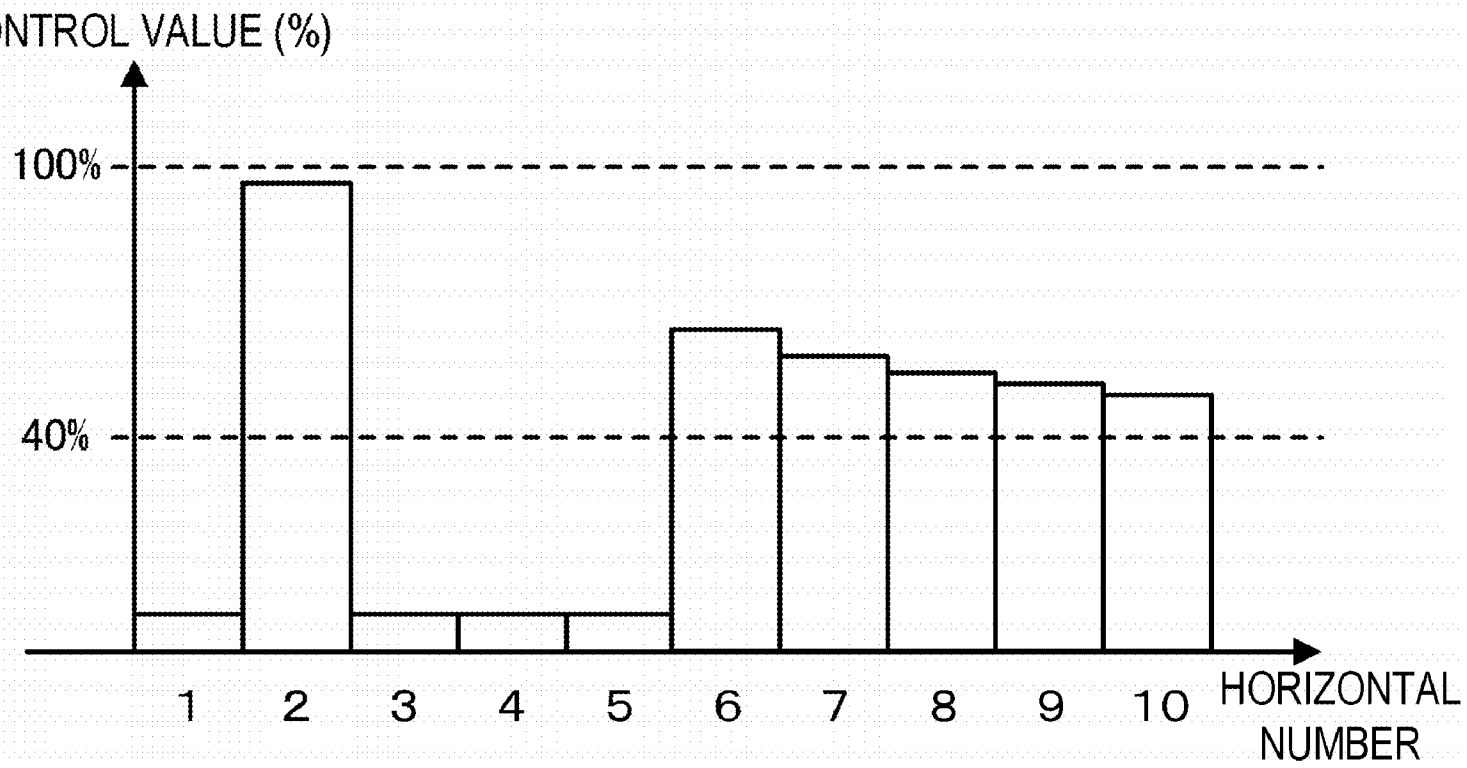
FIG. 18 is a diagram showing an example of an adjustment result of tentatively-determined backlight control values.
Figure 19:
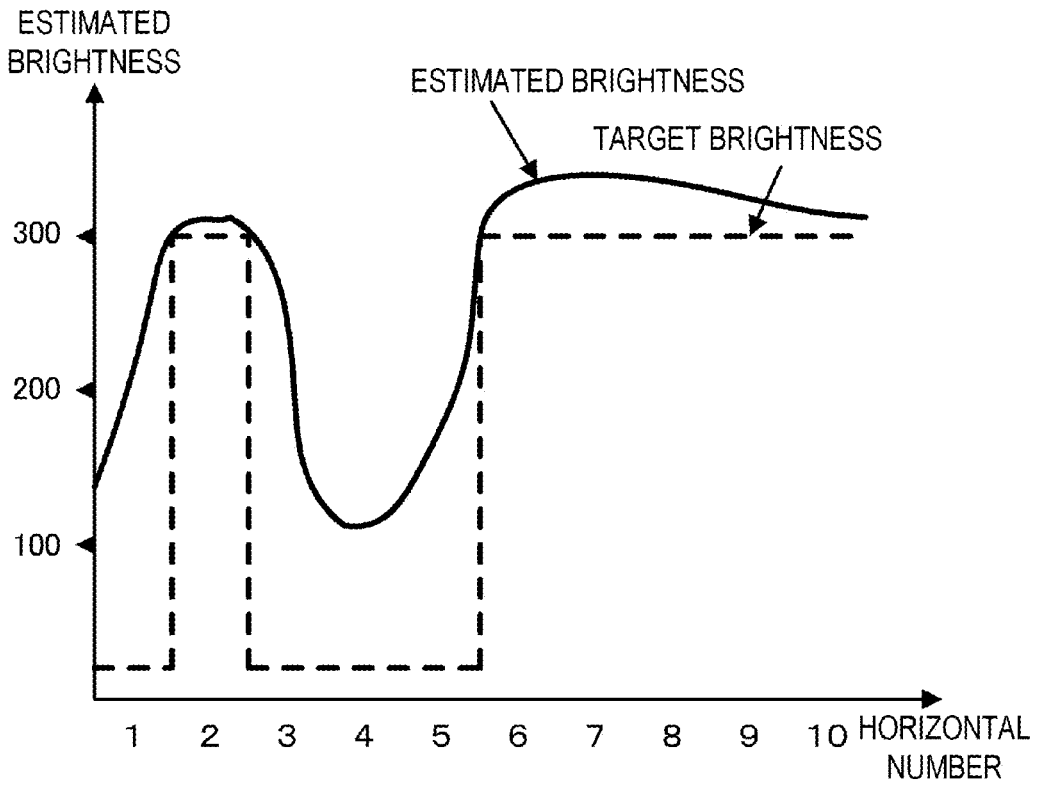
FIG. 19 is a diagram showing an example of the estimated brightness obtained from backlight control values after adjustment.

Hereinafter, an image display apparatus and a control method thereof according to a fourth embodiment of the present invention will be described. In the second and third embodiments, when a required current amount is greater than a predetermined current amount, the emission brightness of divided regions surrounding an isolated high-brightness region is increased while the emission brightness of other divided regions is reduced. In the present embodiment, when a required current amount is greater than a predetermined current amount, the emission brightness of a divided region whose estimated brightness is determined to be lower than the target brightness is set as the emission brightness that is higher than corresponding brightness, and the emission brightness of other divided regions is set to a value equal to the corresponding brightness. Even with such a configuration, a similar effect as the second embodiment can be obtained. A configuration of an image display apparatus according to the present embodiment is similar to that of the second embodiment. However, an isolated high-brightness region detecting unit is no longer required. When a current limit flag is received, the backlight control value tentative determination unit increases corresponding brightness (a tentatively-determined backlight control value) of a divided region whose estimated brightness is determined to be lower than the target brightness. When the tentatively-determined backlight control value of each divided region assumes the value shown in FIG. 8, estimated brightness has a distribution such as that shown in FIG. 9. Therefore, a backlight control value of the six divided regions with horizontal numbers 2, 6, 7, 8, 9, and 10 is increased. Specifically, the backlight control values of the six divided regions are increased based on a difference between estimated brightness (backlight brightness when light is emitted from the backlight at corresponding brightness) and the target brightness so that the backlight brightness of each divided region equals or exceeds the target brightness. Since the target brightness with the horizontal number 2 is 2.14 times the backlight brightness when light is emitted from the backlight at the corresponding brightness, the backlight control value with the horizontal number 2 can be increased by 2.14 times or more. In the present embodiment, the backlight control value with the horizontal number 2 is multiplied by 2.14×1.15. This is because if the effect of peripheral leakage light is large, even if the backlight control value of one divided region is increased by a deficit relative to the target brightness, the backlight brightness does not reach the target brightness. The backlight control value with the horizontal number 2 shown in FIG. 8 is increased to 40%×2.14×1.15=98%. In a similar manner, the backlight control value of the five divided regions with the horizontal numbers 6, 7, 8, 9, and 10 is also increased. FIG. 18 shows an example of an adjustment result of corresponding brightness (tentatively-determined backlight control values) shown in FIG. 8. FIG. 19 shows the backlight brightness in a case where light is emitted from the backlight at the backlight control value shown in FIG. 18. As shown in FIG. 18, the backlight control values of the six divided regions with the horizontal numbers 2, 6, 7, 8, 9, and 10 have been increased from the values shown in FIG. 8. As a result, as shown in FIG. 19, the backlight brightness of each divided region equals or exceeds the target brightness. Therefore, reproducibility of brightness of an image can be enhanced without having to adjust (multiplication by an increase rate) a backlight control value by the backlight control value determining unit. In addition, in FIG. 18, since the backlight control value of divided regions other than the divided region with the horizontal number 2 is lower than the value shown in FIG. 10, required current amount has been reduced.

As described above, in the present embodiment, when a required current amount is greater than a predetermined current amount, the emission brightness of a divided region whose estimated brightness is determined to be lower than the target brightness is set as the emission brightness that is higher than corresponding brightness, and the emission brightness of other divided regions is set to a value equal to the corresponding brightness. Accordingly, an effect similar to that of the second embodiment can be produced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-186503, filed on Aug. 27, 2012, which is hereby incorporated by reference herein in its entirety.

What is claimed is:

1. An image display apparatus comprising:

a plurality of light sources capable of separately controlling emission brightness for each of a plurality of divided regions in a screen; and a processor configured to:

perform a determining processing that determines a target brightness of a predetermined divided region, based on image data corresponding to the predetermined divided region;

perform an estimating processing that estimates the brightness of the predetermined divided region in a case where light is emitted by the light source for the predetermined divided region at an emission brightness which is based on image data in each of the plurality of divided regions; and in a case that the brightness estimated by the estimating processing is lower than the target brightness determined by the determining processing, perform a control processing that increases the emission brightnesses of two or more light sources corresponding to two or more divided regions including the predetermined divided region at the same increase rate.

2. The image display apparatus according to claim 1, wherein the predetermined divided region is a divided region where the difference between the estimated brightness and the target brightness is a maximum among the plurality of divided regions.

3. The image display apparatus according to claim 1, wherein in the control processing, the emission brightnesses of all light sources are increased at the increase rate.

4. The image display apparatus according to claim 1, wherein the increase rate is based on the difference between the brightness estimated by the estimating processing and the target brightness determined by the determining processing.

5. The image display apparatus according to claim 1, wherein:

the processor further performs a brightness distribution estimating processing that estimates a brightness distribution in a case where light is emitted by the light source for the predetermined divided region at the emission brightness determined by the control processing; and a correcting processing that corrects the image data based on the brightness distribution estimated by the brightness distribution estimating processing.

6. The image display apparatus according to claim 1, wherein in the control processing, the emission brightness is controlled so that the brightness equals or exceeds the target brightness at all positions in the predetermined divided region.

7. A control method for an image display apparatus including a plurality of light sources capable of separately controlling emission brightness for each of a plurality of divided regions in a screen, the control method comprising:

a determining step of determining target brightness of a predetermined divided region, based on image data corresponding to the predetermined divided region;

an estimating step of estimating the brightness of the predetermined divided region in a case where light is emitted by the light source for the predetermined divided region at emission brightness which is based on image data in each of the plurality of divided regions; and a control step of increasing, in a case that the brightness estimated in the estimating step is lower than the target brightness determined in the determining step, the emission brightnesses of two or more light sources corresponding to two or more divided regions including the predetermined divided region at the same increase rate.

8. The control method according to claim 7, wherein the predetermined divided region is a divided region where the difference between the estimated brightness and the target brightness is a maximum among the plurality of divided regions.

9. The control method according to claim 7, wherein in the control step, emission brightnesses of all light sources are increased at the increase rate.

10. The control method according to claim 7, wherein the increase rate is based on the difference between the brightness estimated in the estimating step and the target brightness determined in the determining step.

11. The control method according to claim 7, further comprising:

a brightness distribution estimating step of estimating a brightness distribution in a case where light is emitted by the light source for the predetermined divided region at the emission brightness determined in the control step; and a correcting step of correcting image data based on the brightness distribution estimated in the brightness distribution estimating step.

12. The control method according to claim 7, wherein in the control processing, the emission brightness is controlled so that the brightness equals or exceeds the target brightness at all positions in the predetermined divided region.

13. An image display apparatus comprising:

a plurality of light sources capable of separately controlling the emission brightness for each of a plurality of divided regions in a screen;

a determining circuit configured to determine a target brightness of a predetermined divided region, based on image data corresponding to the predetermined divided region;

an estimating circuit configured to estimate the brightness of the predetermined divided region in a case where light is emitted by the light source for the predetermined divided region at the emission brightness which is based on image data in each of the plurality of divided regions; and a control circuit configured to increase, in a case that the brightness estimated by the estimating circuit is lower than the target brightness determined by the determining circuit, the emission brightnesses of two or more light sources corresponding to two or more divided regions including the predetermined divided region at the same increase rate.

14. An image display apparatus comprising:

a plurality of light sources configured to separately control the emission brightness for each of a plurality of divided regions of a screen; and a processor configured to:

perform a determining processing that determines a target brightness of one of the plurality of divided regions based on image data corresponding to the one of the plurality of divided regions;

perform an estimating processing operation that estimates the estimated brightness emitted to the one of the plurality of divided regions in a case where light is emitted by each of the light sources at an emission brightness based on the image data corresponding to each of the plurality of divided regions; and in a case where the estimated brightness of the one of the plurality of divided regions is lower than the target brightness of the one of the plurality of divided regions, perform a control processing operation that increases the emission brightnesses of two or more light sources corresponding to two or more divided regions including the one of the plurality of divided regions wherein the increase rate at which the emission brightness of a light source corresponding to the one of the plurality of divided regions increases is the same as the increase rate at which the emission brightness of other light sources among the two or more light sources increases.

15. The image display apparatus according to claim 14, wherein in the determining process, a target brightness of each of the plurality of divided regions is determined based on the image data corresponding to each of the plurality of divided regions, in the estimating process, an estimated brightness emitted to each of the plurality of divided regions is estimated in a case where light is emitted by each of the light sources at an emission brightness based on the image data corresponding to each of the plurality of divided regions, the estimated brightness of the one of the plurality of divided regions is lower than the target brightness of the one of the plurality of divided regions, and the difference between the estimated brightness of the one of the plurality of divided regions and the target brightness of the one of the plurality of divided regions is a maximum among the plurality of divided regions.

16. The image display apparatus according to claim 14, wherein in the control processing, the emission brightnesses of all light sources corresponding to all divided regions are increased at the increase rate.

17. The image display apparatus according to claim 14, wherein the increase rate is based on the difference between the estimated brightness of the one of the plurality of divided regions and the target brightness of the one of the plurality of divided regions.

18. The image display apparatus according to claim 14, wherein the processer further performs:

a brightness distribution estimating processing operation that estimates the brightness distribution in a case where light is emitted by each of the light sources at the emission brightness determined by the control processing; and a correcting processing operation that corrects the image data based on the brightness distribution estimated by the brightness distribution estimating processing.

19. The image display apparatus according to claim 14, wherein in the control processing, the emission brightness is controlled so that the estimated brightness equals or exceeds the target brightness at all positions in the one of the plurality of divided regions.

20. A control method for an image display apparatus including a plurality of light sources configured to separately control the emission brightness for each of a plurality of divided regions in a screen, the control method comprising:

a determining step of determining a target brightness of one of the plurality of divided regions based on image data corresponding to the one of the plurality of divided regions;

an estimating step of estimating the estimated brightness emitted to the one of the plurality of divided regions in a case where light is emitted by each of the light sources at an emission brightness based on the image data corresponding to each of the plurality of divided regions; and a control step of increasing, in a case where the estimated brightness of the one of the plurality of divided regions is lower than the target brightness of the one of the plurality of divided regions, the emission brightnesses of two or more light sources corresponding to two or more divided regions including the one of the plurality of divided regions, wherein the increase rate at which the emission brightness of a light source corresponding to the one of the plurality of divided regions increases is the same to the increase rate at which the emission brightness of other light sources among the two or more light sources increases.

21. The image display apparatus according to claim 14, wherein the increase rate is determined according to the difference between the estimated brightness of the one of the plurality of divided regions and the target brightness of the one of the plurality of divided regions.

* * * * *